US012601570B1

(12) United States Patent
Jones

(10) Patent No.: US 12,601,570 B1
(45) Date of Patent: Apr. 14, 2026

(54) TACTICAL LASER DEFENSE SYSTEM

(71) Applicant: Johnny Jones, Cincinnati, OH (US)

(72) Inventor: Johnny Jones, Cincinnati, OH (US)

( * ) Notice: Subject to any disclaimer, the term of this patent is extended or adjusted under 35 U.S.C. 154(b) by 0 days.

(21) Appl. No.: 18/882,620

(22) Filed: Sep. 11, 2024

Related U.S. Application Data

(60) Provisional application No. 63/537,812, filed on Sep. 11, 2023.

(51) Int. Cl.
*F41H 13/00* (2006.01)
*F41H 11/02* (2006.01)

(52) U.S. Cl.
CPC ..... *F41H 13/005* (2013.01); *F41H 11/02* (2013.01)

(58) Field of Classification Search
CPC ..... F41H 13/005; F41H 11/02
USPC ..... 89/1.1
See application file for complete search history.

(56) References Cited

U.S. PATENT DOCUMENTS 5,198,607 A * 3/1993 Livingston ..... F41H 13/0062 89/1.11
8,573,110 B2 11/2013 Jones
2020/0108922 A1* 4/2020 Smith ..... G05D 1/12
2025/0130022 A1* 4/2025 Paranto ..... B63G 8/28

FOREIGN PATENT DOCUMENTS

WO WO-2009002300 A1 * 12/2008 ..... F41H 11/02

* cited by examiner

*Primary Examiner* — Samir Abdosh
(74) *Attorney, Agent, or Firm* — The Law Office of Patrick F. O'Reilly, III, LLC

(57) ABSTRACT

A tactical laser defense system includes one or more tactical lasers configured to emit one or more respective laser beams at a particular target; one or more other tactical devices comprising at least one of: (i) a camera to capture images and/or video of an area surrounding the tactical laser defense system, (ii) a light source for illuminating the area surrounding the tactical laser defense system, (iii) a microphone for capturing audio information from the area surrounding the tactical laser defense system, and (iv) radar equipment for detecting enemy threats; and a power source operatively coupled to the one or more tactical lasers and the one or more other tactical devices, the power source configured to provide electrical power to the one or more tactical lasers and the one or more other tactical devices.

20 Claims, 32 Drawing Sheets

TACTICAL LASER DEFENSE SYSTEM

CROSS-REFERENCE TO RELATED APPLICATIONS

This patent application claims priority to, and incorporates by reference in its entirety, U.S. Provisional Patent Application No. 63/537,812 entitled "Coast-to-coast Border-to-border Tactical Laser Defense Network", filed on Sep. 11, 2023.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a tactical laser defense system. More particularly, the invention relates to a tactical laser defense system configured to be installed underground, in-ground, or above ground for protecting a particular facility.

2. Background

The land-based national defense system currently in place in the United States uses missiles launched from silos to retaliate for any intercontinental ballistic missiles (ICBMs) or other missiles that are fired at any U.S. property. There are aerial and ocean-based defenses as well that can launch missiles for defensive and offensive purposes, but there are no known existing broad-based defense systems that are stationary and that use lasers for defense in a network for coverage of a country like the United States.

Therefore, what is needed is a tactical laser defense system that is configured to be installed underground, in-ground, or above ground so as to protect a particular facility.

BRIEF SUMMARY OF EMBODIMENTS OF THE INVENTION

Accordingly, the present invention is directed to a tactical laser defense system that substantially obviates one or more problems resulting from the limitations and deficiencies of the related art.

In accordance with one or more embodiments of the present invention, there is provided a tactical laser defense system that includes one or more tactical lasers, the one or more tactical lasers configured to emit one or more respective laser beams at a particular target; one or more other tactical devices, the one or more other tactical devices comprising at least one of: (i) a camera to capture images and/or video of an area surrounding the tactical laser defense system, (ii) a light source for illuminating the area surrounding the tactical laser defense system, (iii) a microphone for capturing audio information from the area surrounding the tactical laser defense system, and (iv) radar equipment for detecting enemy threats; and a power source operatively coupled to the one or more tactical lasers and the one or more other tactical devices, the power source configured to provide electrical power to the one or more tactical lasers and the one or more other tactical devices. In these one or more embodiments, the one or more tactical lasers and the one or more other tactical devices are configured to be installed underground, in-ground, or above ground for protecting a particular facility.

In a further embodiment of the present invention, the power source for the one or more tactical lasers and the one or more other tactical devices comprises a turbine, the turbine configured to be installed underground, in-ground, or above ground, and the turbine configured to operate as an alternate power source for the particular facility.

In yet a further embodiment, the turbine is installed in-ground or underground in a pit, the pit being surrounded by barrier walls, at least one of the barrier walls being sloped to so as to deter ground assaults on the pit, and the pit further comprising a sump pump and sump pump drainage line for removing any accumulated water from the pit.

In still a further embodiment, the one or more tactical lasers and the one or more other tactical devices are mounted on a tower structure, and the tower structure is installed in-ground or underground in a subterranean silo adjacent to the pit with the turbine, the subterranean silo including one or more operable doors at an upper end of the subterranean silo. In this further embodiment, when the one or more operable doors at the upper end of the subterranean silo are opened, the tower structure is raised to above a surface of the ground so that the one or more tactical lasers are in an operative position for emitting the one or more respective laser beams at the particular target.

In yet a further embodiment, the tower structure is disposed on a lift table that is configured to be displaced along one or more lift tracks as the tower structure is raised to above the surface of the ground.

In still a further embodiment, the tactical laser defense system further comprises an electrical power cable and/or an electrical communications cable, the electrical power cable configured to provide power to at least the one or more tactical lasers and one or more other tactical devices of the tactical laser defense system, and the electrical communications cable configured to provide communication signals to at least the one or more tactical lasers so that aiming and firing of the one or more tactical lasers are able to be controlled by operators at the particular facility.

In yet a further embodiment, the tactical laser defense system further comprises a spooling winch assembly that includes a cable spool to hold an unextended portion of the electrical power cable and/or the electrical communications cable. In this further embodiment, as the tower structure is raised to the surface of the ground with the lift table displaced along the one or more lift tracks, the electrical power cable and/or the electrical communications cable unrolls from the cable spool of the spooling winch assembly.

In still a further embodiment, the turbine is configured for one or more of the following fuel sources: (i) jet fuel, (ii) gasoline, (iii) natural gas, (iv) propane, and (v) combinations thereof.

In yet a further embodiment, at least one of the one or more tactical lasers of the tactical laser defense system comprises a high-intensity tactical megawatt laser.

In still a further embodiment, the one or more tactical lasers are disposed in an elevated position on a tower structure, and at least one of the one or more tactical lasers of the tactical laser defense system is mounted on a brace structure, the brace structure allowing the at least one of the one or more tactical lasers to be rotated and/or tilted as needed to aim the at least one of the one or more tactical lasers at the particular target.

In yet a further embodiment, the tactical laser defense system further comprises an accessory frame and an accessory platform, the accessory frame being attached between the brace structure of the tactical laser defense system and the accessory platform, the one or more other tactical devices being mounted on the accessory platform, and the accessory platform being mounted on the tower structure in the elevated position.

In still a further embodiment, the one or more other tactical devices of the tactical laser defense system include the camera to capture images and/or video of the area surrounding the tactical laser defense system, the camera being mounted on the accessory platform and being disposed within the accessory frame beneath the one or more tactical lasers.

In yet a further embodiment, the one or more other tactical devices of the tactical laser defense system include the light source for illuminating the area surrounding the tactical laser defense system, the light source emitting visible light and/or infrared light, and the light source being mounted on the accessory platform and being disposed within the accessory frame beneath the one or more tactical lasers.

In still a further embodiment, the one or more other tactical devices of the tactical laser defense system include the microphone for capturing audio information from the area surrounding the tactical laser defense system, and the microphone being mounted on the accessory platform and being disposed within the accessory frame beneath the one or more tactical lasers.

In yet a further embodiment, the one or more other tactical devices of the tactical laser defense system include the radar equipment for detecting enemy threats, and the radar equipment being mounted on the accessory platform and being disposed within the accessory frame beneath the one or more tactical lasers.

In still a further embodiment, the tower structure is mounted on a top of a control tower or other building structure at the particular facility.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
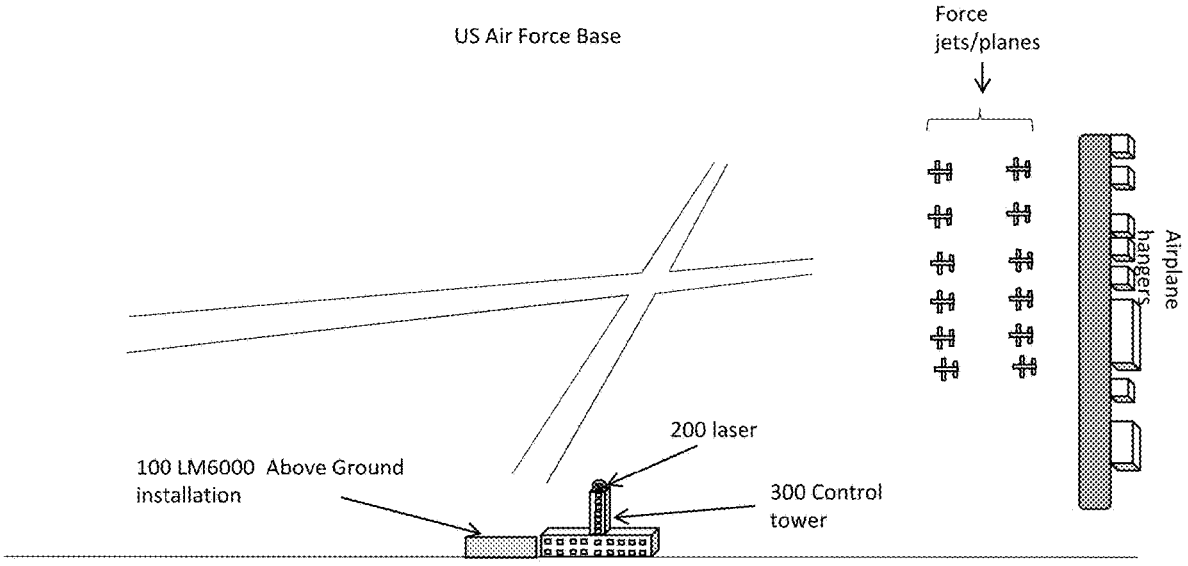
FIG. 1 diagrammatically depicts to a tactical laser defense system at an air force base, according to an illustrative embodiment of the invention.

In one or more embodiments described hereinafter, a tactical laser defense system is illustrated and described, which can be deployed at multiple air force bases as well as other strategic locations. This tactical laser defense system may use one or more turbines (e.g., one or more General Electric® LM6000 turbines) that provide both a supply of electrical power to each facility as well as the power to a high-intensity tactical megawatt laser defense system at each location. These lasers can protect against any threats from air, land, or sea that are detected. The network aspect of this laser defense system is basically the military network for defense purposes that allows various military installations to be informed of defense and offense tactical plans and action orders. These tactical laser defense systems are configured as state-of-the-art systems designed to counter the latest missiles that operate at hypersonic speeds, and so need high-powered lasers that operate in the megawatt range. On an emergency basis, these turbines can also provide some emergency power to select civilian facilities in the vicinity of the installation sites if that is approved by the military leaders and the president of the country.

In these one or more embodiments, the turbines allow each facility to operate off the grid and still be able to support the needed functionalities of the installation facility as well as the laser defense operations, although the support of the laser defense operations is the primary goal. Most currently designed turbines in operation are powered by either propane or natural gas. However, in the one or more embodiments described hereinafter, in order to increase the long-term source of fuel to the turbines used, the turbines are additionally capable of being fueled by jet fuel in addition to the current fuels used since jet fuel is in abundant supply at air force bases and airports. Another fuel source for the turbines can be regular gasoline in addition to the jet fuel option. The intent is that the turbines can run off whichever of these fuels is available in support of long-term usability.

Although other facilities besides air force bases are discussed here, the first application described herein is at these bases since there are typically multiple of these locations around a particular country. In this first application, high-intensity tactical megawatt lasers of the tactical laser defense systems may be provided on the control towers at the air force bases. In one or more embodiments described hereinafter, the tactical lasers of the tactical laser defense systems may have one or more of the following characteristics:

i. The lasers may be powerful enough (e.g., in the megawatt range) to handle hypersonic missiles since these are a threat to any defense system.

ii. The lasers may have a supersonic speed that is at least five to ten times the speed of sound (e.g., laser beams from the lasers emitted at the speed of light).

iii. The lasers may have a hypersonic speed that is at least ten to 20 times the speed of sound (as some enemy hypersonic missiles have been recorded with speeds up to Mach 20).

iv. The lasers may be powered by a turbine (e.g., a GE® LM6000 turbine).

v. The lasers may be capable of attacking all types of surface vessels and aerial aircraft and/or weapons' threats such as surface-to-air missiles, satellites, drones-both ground-based and aerial, RPGs and the launchers of those RPGs, given sufficient power and positioning-using weapons recognition software to determine the nature of the threat and being able to determine if the weapon is friendly or an enemy's weapon.

vi. The lasers may have the ability to adjust the laser beam's power based upon the threat where, for example, an RPG may require only 60 KW of intensity, but a surface-to-air missile may require 300 KW beam power. The system can self-adjust. In some cases, the laser may require more kilowatts, i.e., intensity to disable or destroy a target. In one or more embodiments, the laser will have capacity in the megawatt range when necessary.

vii. Considering the tremendous amount of heat generated by the continuous usage of the laser, a cooling system is needed in one or more embodiments.

viii. The lasers may have the ability to temporarily blind enemy satellites and/or burn out the optics of these satellites.

In one or more embodiments described hereinafter, a coast-to-coast, border-to-border tactical laser defense network is described that is formed by a plurality of tactical laser defense systems. Each of the tactical laser defense systems may comprise two foundation components-a turbine (e.g., GER LM6000 turbine) and a high-intensity tactical megawatt laser—that are to be placed at air force bases and other locations around a country to provide a defense network. In these one or more embodiments, the turbine supplies power to the air base and to the laser which is to be mounted on a high point on the base-usually on the control tower—for the best vantage point to attack any threats by air, land, or sea. The turbine also may be an alternative power source for the base and even the surrounding community in case of a power outage. The turbine (e.g., GE® LM6000 turbine) can either be installed underground, in-ground, or above ground with the preferred installation being in-ground.

What follows are the details on how an illustrative embodiment of the tactical laser defense system and associated network may be constructed and how they may operate. Subsequent figures will show the various ways the laser can be deployed and exemplary details on the functionality of the turbine. The figures described hereinafter will show the illustrative embodiment of the tactical laser defense system, and how the components of the system interact with one another. The figures described hereinafter present a diagrammatic representation of the tactical laser defense system, and are not meant to be exhaustive of all the construction details of the tactical laser defense system. Also, the drawings are not to scale or indicative of a size comparison among the various items being illustrated.

The invention is capable of other embodiments and of being practiced and carried out in various ways. Also, it is to be understood that the phraseology and terminology employed herein are for the purpose of descriptions and should not be regarded as limiting.

Figure 2:
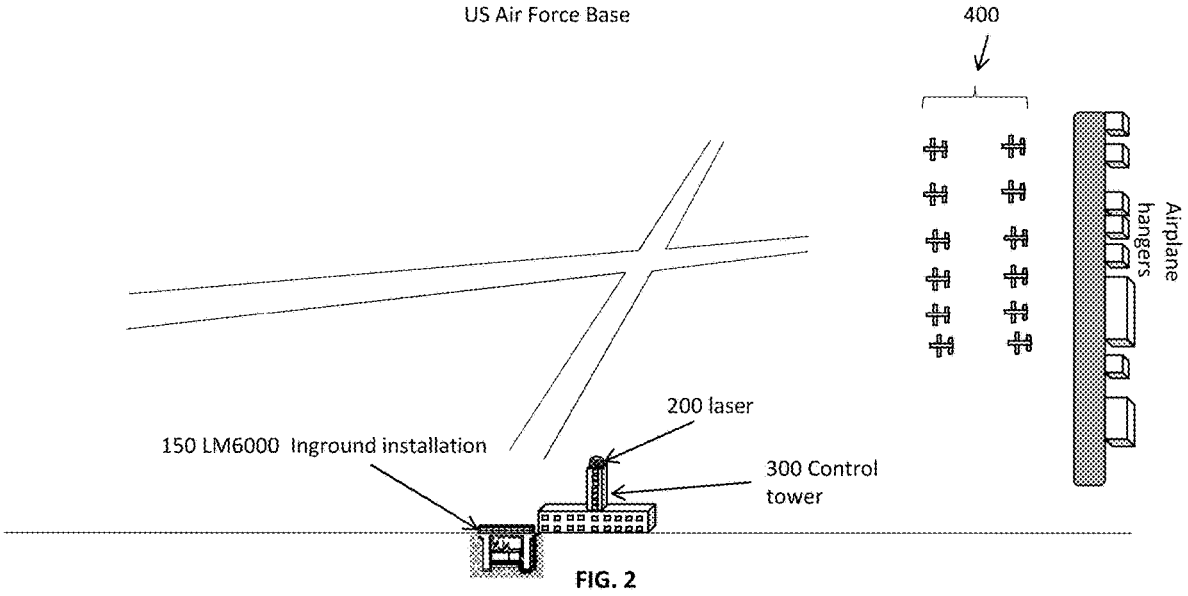
FIG. 2 diagrammatically depicts another tactical laser defense system at an air force base, according to an alternative illustrative embodiment of the invention, wherein the power source of the tactical laser defense system is provided in-ground.
Figure 3:
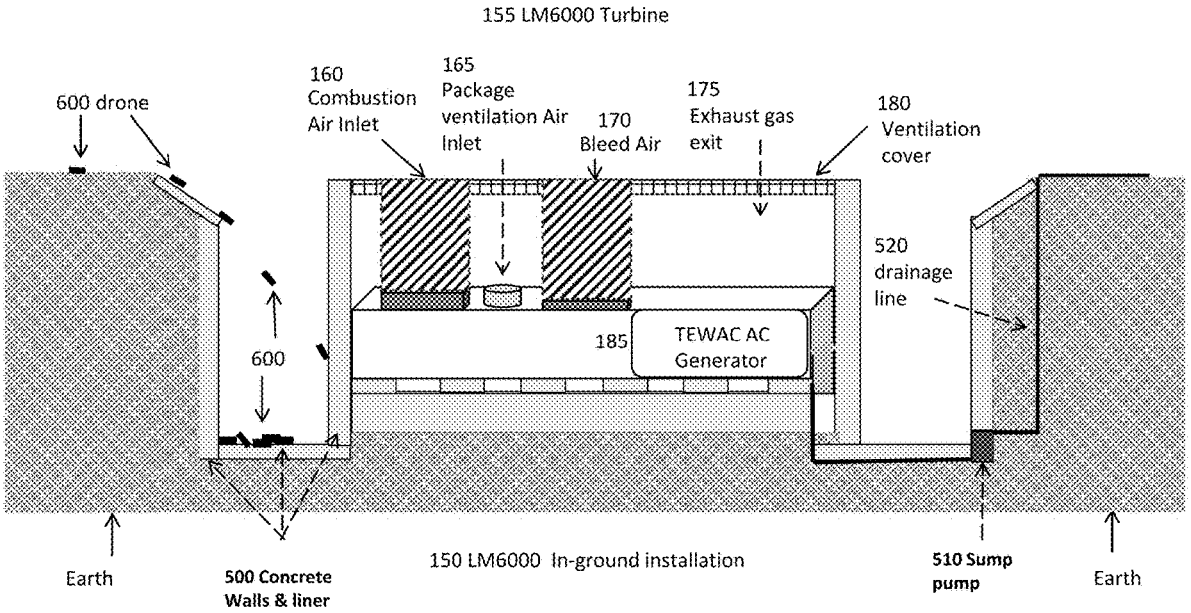
FIG. 3 depicts an enlarged view of the in-ground installation of the power source of the tactical laser defense system of FIG. 2.

Now, with reference to FIGS. 1-16C, illustrative embodiments of the tactical laser defense system will be described in detail. Initially, referring to FIG. 1 of the illustrative embodiment, an air force base is represented by several hangers, a set of planes 400 on the ground, runways, and a control tower 300. Added to the existing structures is an above-ground turbine installation 100, which is inside a building or other structure preferably of concrete or other substantial material, and a high-intensity tactical megawatt laser 200 mounted on the control tower 300. In FIG. 2, is shown the same air base layout with an in-ground LM6000 installation 150 illustrated (for added security). A close-up view of the in-ground installation is illustrated in FIG. 3. First note that the turbine is in a pit that is surrounded by concrete walls with liners 500 and the pit contains a sump pump 510 and sump pump drainage line 520. A portion of the concrete wall on either side of the turbine at ground level where the pit begins is sloped so that any ground attack by some threat like wheeled drones 600 will result in those threats dropping into the pit area and being disabled. The concrete walls are also to protect against any explosives these drones, or other threats, might be armed with. Continuing with the components for the LM6000 turbine 155 these are displayed and merely mentioned here as these turbines are already in use and this invention is another application where the turbines are effective in a different environment. From left to right are shown the combustion air inlet 160, the package air inlet 165, ventilation bleed air 170, exhaust gas exit 175, and ventilation cover 180 which is the cover for the entire turbine. A generator 185 (e.g., a totally enclosed water-to-air cooling (TEWAC) alternating current (AC) generator) may also be a component in these turbines. Some factors to be determined at installation arc: (i) the depth and width of the pit; (ii) the thickness of the concrete walls and liners; and (iii) the angle of slope of the top of the pit entry concrete walls.

Not appearing in these initial drawings, but an integral part of embodiments of these installations is the power/communications cables that are to be used to power the base—or other facility where this system is installed, power the laser at the facility and potentially provide a link to the community power grid if the turbine is to supply supplemental or emergency power to the community surrounding the facility. The power cable that extends to the tactical laser is a component that can also contain some communications lines to direct the tactical laser position and laser beam firing intensity and duration.

Also, in one or more embodiments, there are alternative fuel sources for these turbines which currently run on natural gas or propane gas. Since many of these turbines are to be installed at air force bases where jet fuel is in ready supply, a modification to these turbines to burn jet fuel is an alternative that will allow them to run for long periods of time without the import of fuel when that resource might be in short supply. Other alternative fuel is regular gasoline where all these fuel sources can be used by the same turbine based on availability. Also, in one or more embodiments, these turbines are placed in a restricted area with limited access from even base personnel and with the area having its own means of defense against intruders.

Figure 4A:
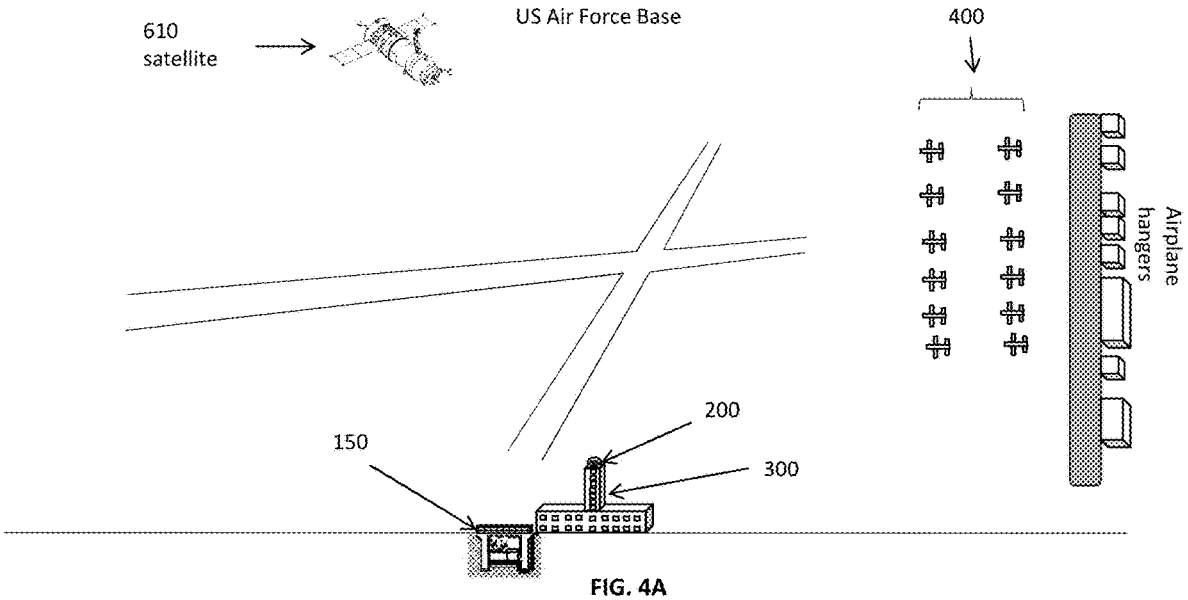
FIG. 4A depicts an aerial threat in a form of an enemy satellite that has been identified in the vicinity of the air force base with the tactical laser defense system of FIG. 2.
Figure 4B:
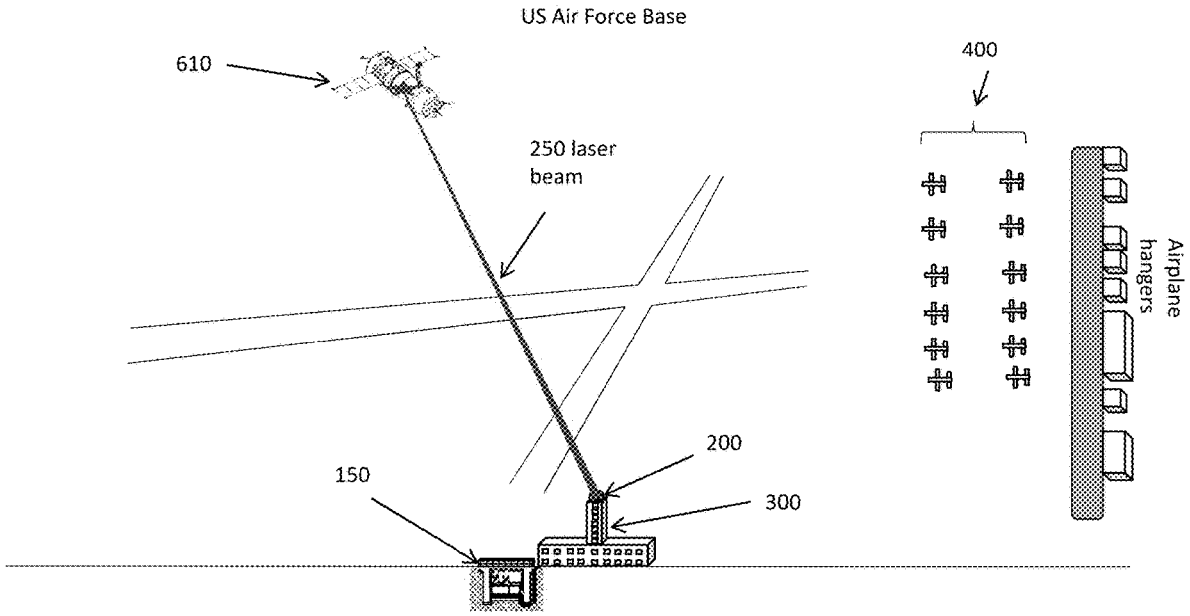
FIG. 4B depicts the enemy satellite being hit by a laser beam from a tactical laser of the tactical laser defense system of FIG. 2.
Figure 5A:
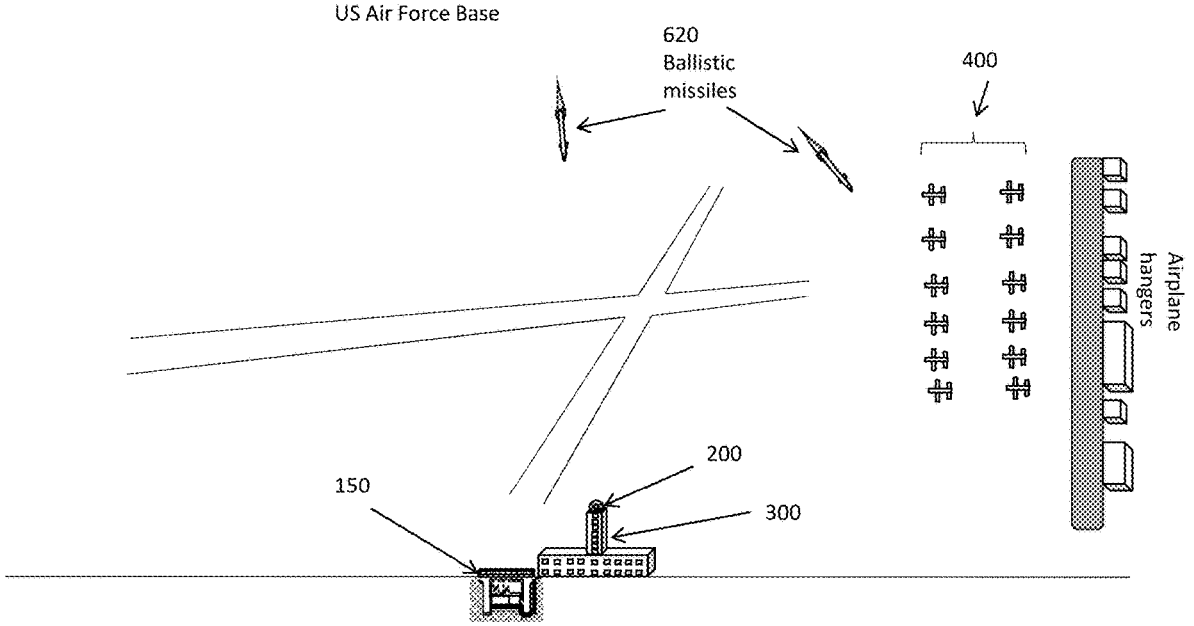
FIG. 5A depicts another aerial threat in a form of ballistic missiles that has been identified in the vicinity of the air force base with the tactical laser defense system of FIG. 2.
Figure 5B:
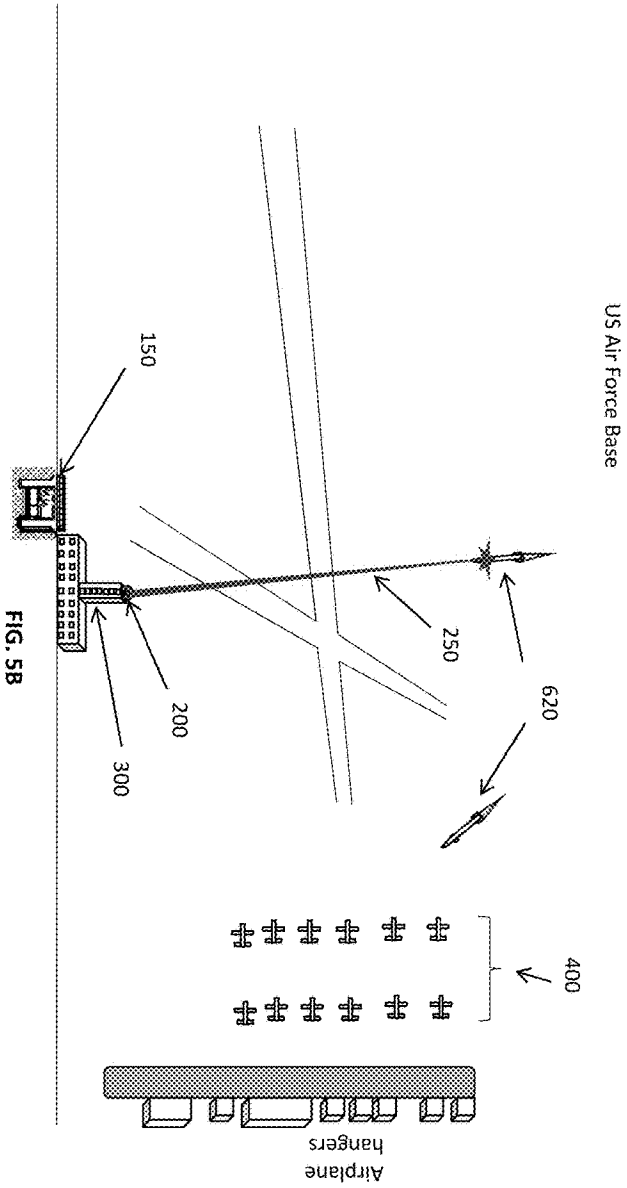
FIG. 5B depicts a first one of the ballistic missiles being hit by a laser beam from the tactical laser of the tactical laser defense system of FIG. 2.
Figure 5C:
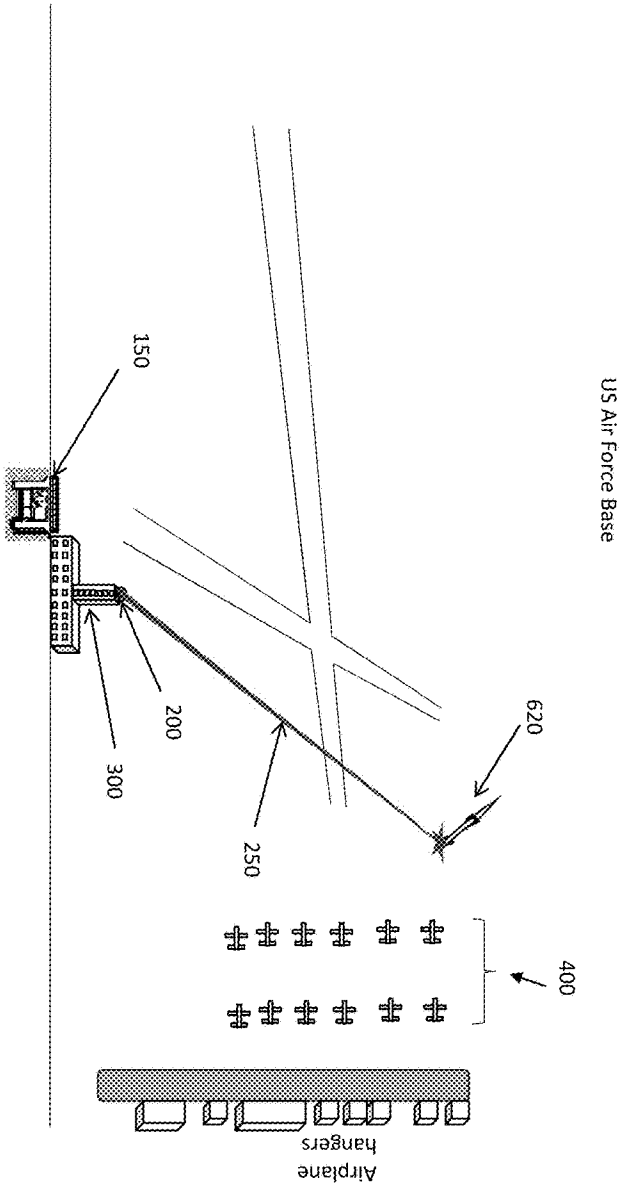
FIG. 5C depicts a second one of the ballistic missiles being hit by a laser beam from the tactical laser of the tactical laser defense system of FIG. 2.
Figure 6A:
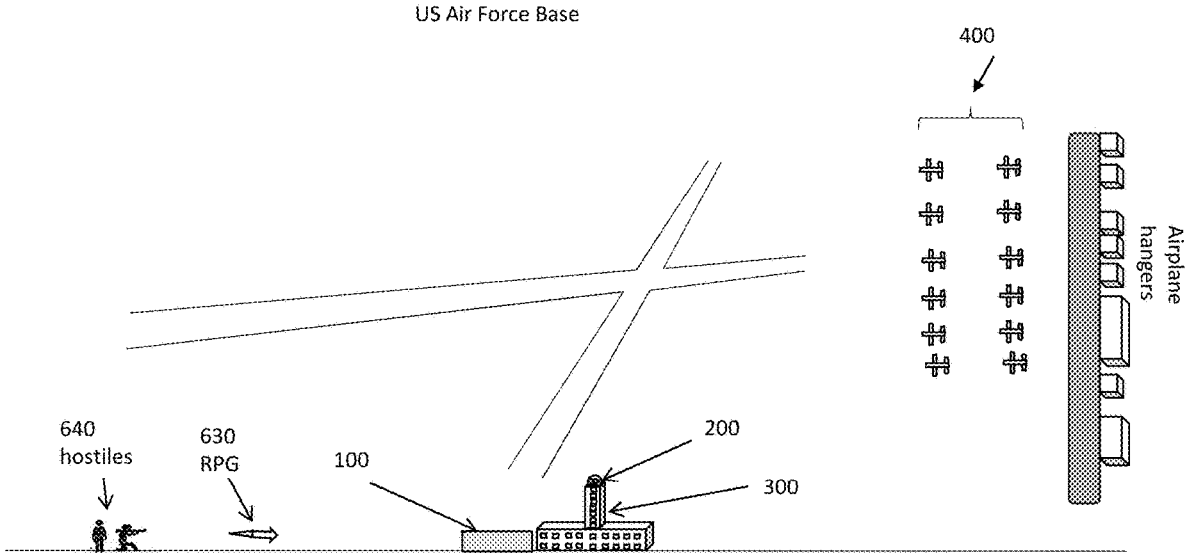
FIG. 6A depicts a ground threat in a form of a rocket-propelled grenade (RPG) that has been identified in the vicinity of the air force base with the tactical laser defense system of FIG. 2.
Figure 6B:
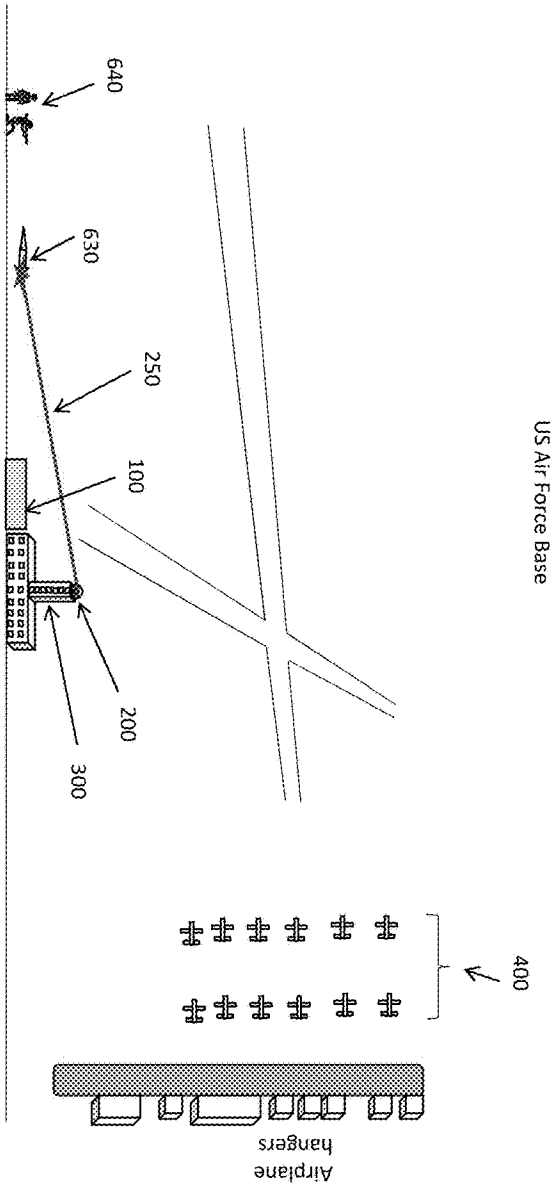
FIG. 6B depicts the rocket-propelled grenade (RPG) being hit by a laser beam from the tactical laser of the tactical laser defense system of FIG. 2.
Figure 6C:
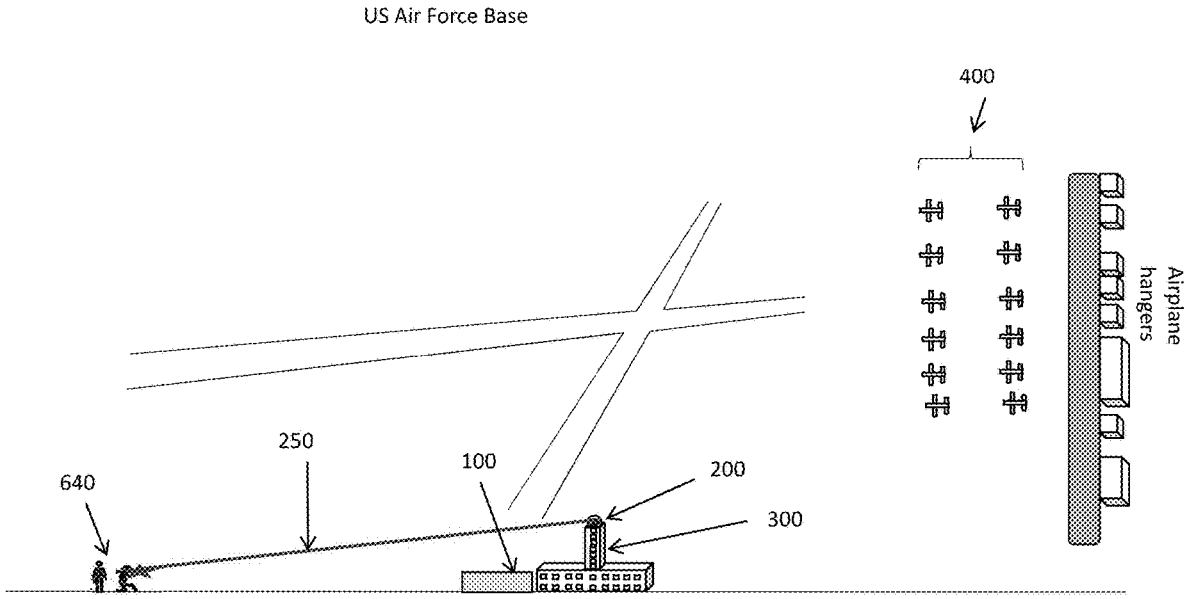
FIG. 6C depicts the RPG launcher hostile being hit by a laser beam from the tactical laser of the tactical laser defense system of FIG. 2.
Figure 6D:
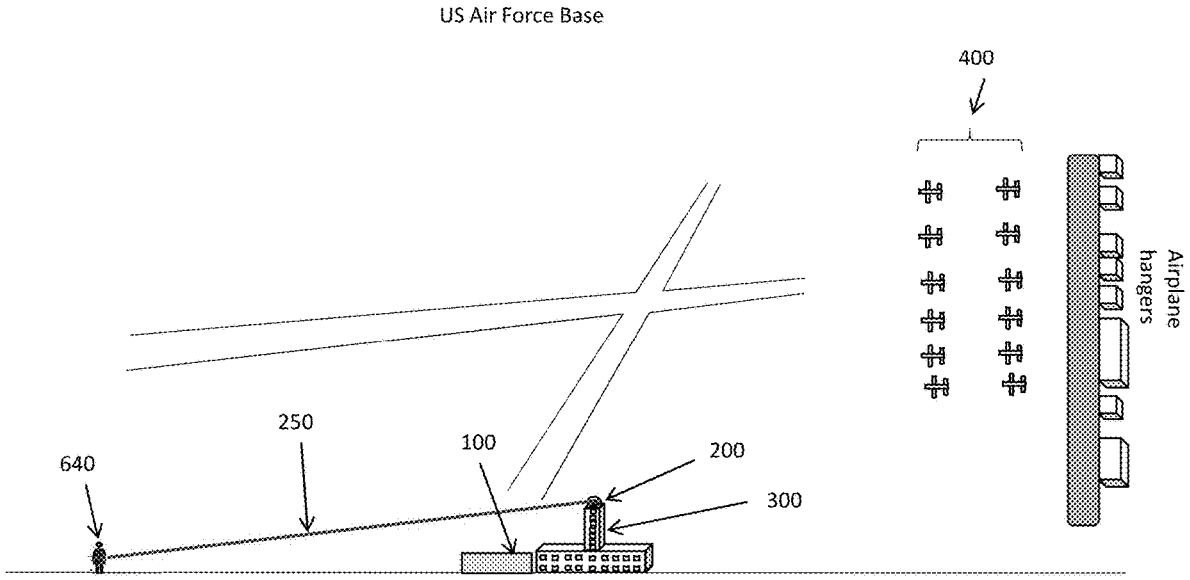
FIG. 6D depicts another hostile being hit by a laser beam from the tactical laser of the tactical laser defense system of FIG. 2.
Figure 7A:
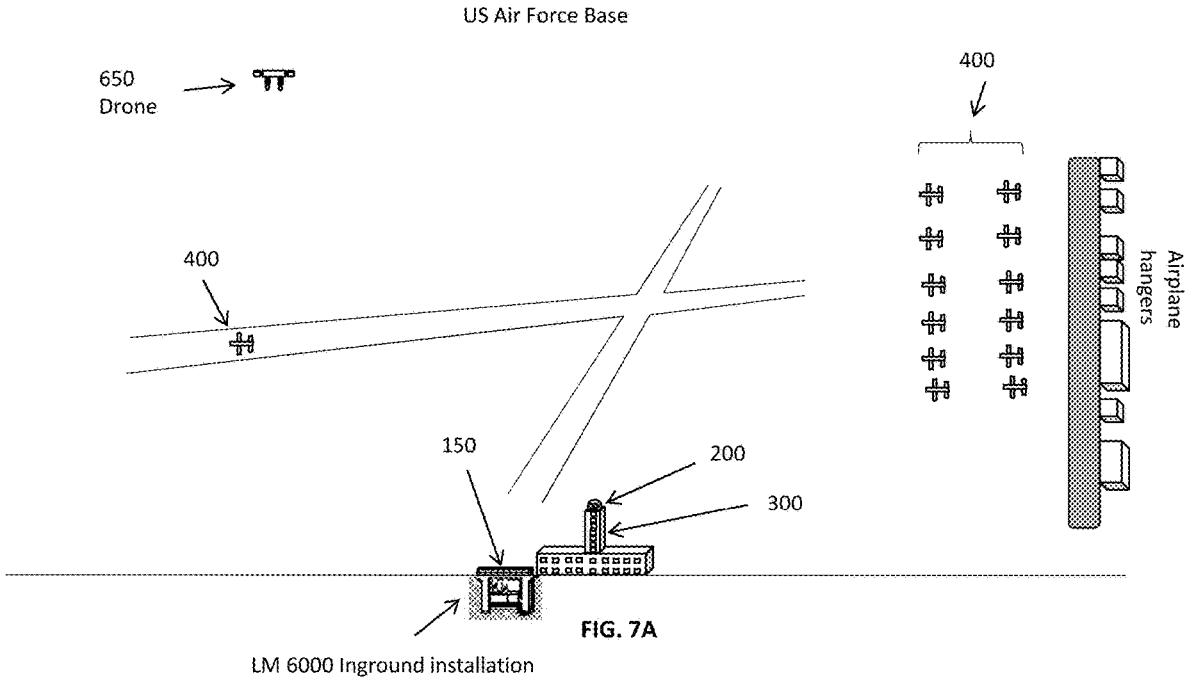
FIG. 7A depicts yet another aerial threat in a form of an aerial drone that has been identified in the vicinity of the air force base with the tactical laser defense system of FIG. 2.
Figure 7B:
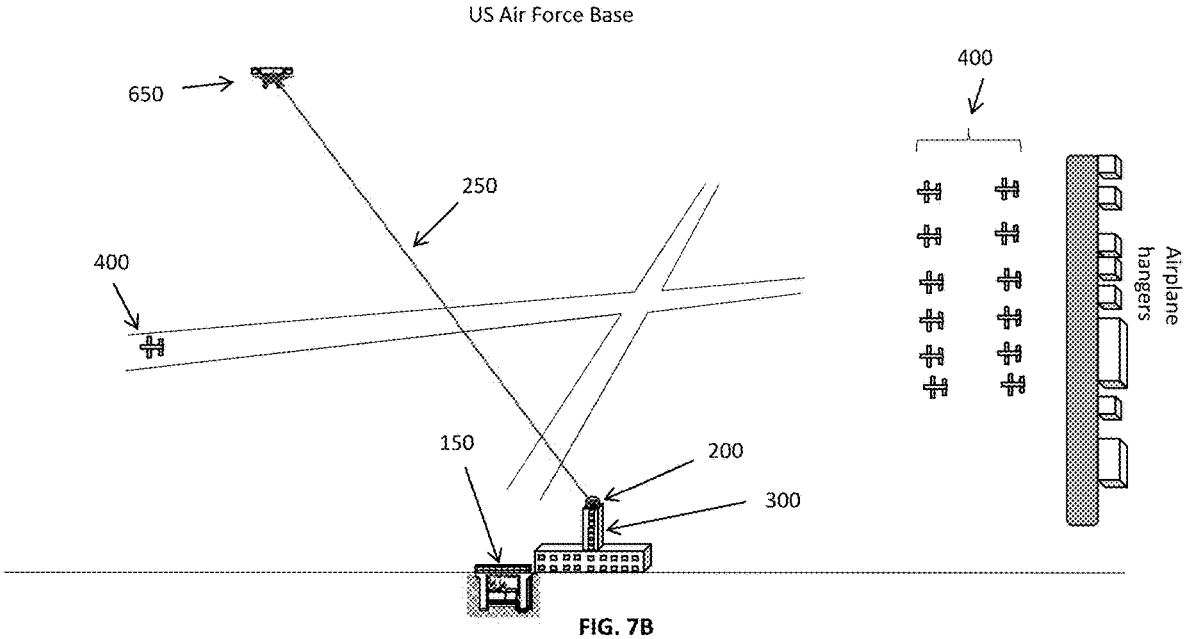
FIG. 7B depicts the aerial drone being hit by a laser beam from the tactical laser of the tactical laser defense system of FIG. 2.
Figure 8A:
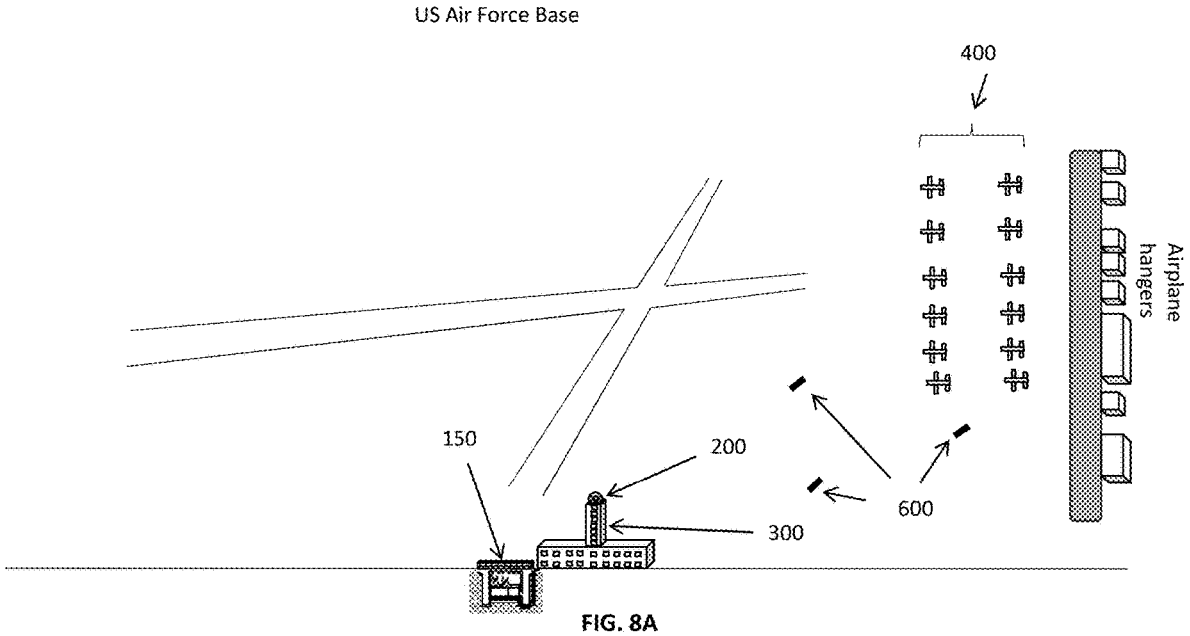
FIG. 8A depicts another ground threat in a form of ground-based drones that have been identified in the vicinity of the air force base with the tactical laser defense system of FIG. 2.
Figure 8B:
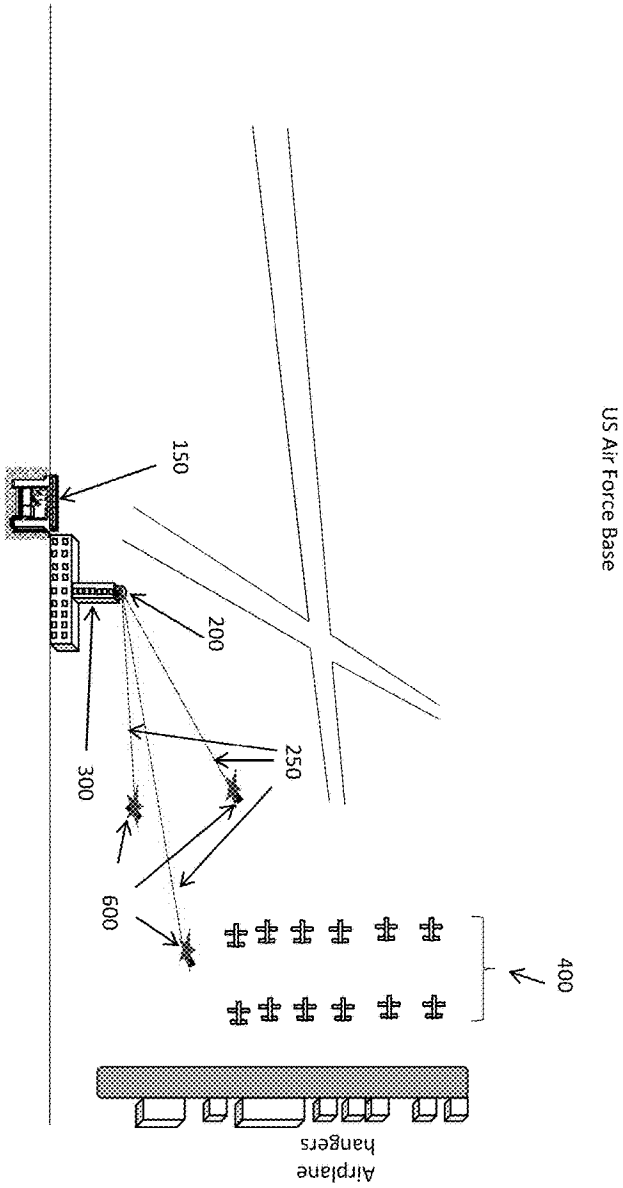
FIG. 8B depicts all of the ground-based drones being hit by laser beams from the tactical laser of the tactical laser defense system of FIG. 2.

To be illustrated next are various ways the high-intensity tactical megawatt laser can be used to disable/destroy various threats that can be encountered at these facilities. In FIG. 4A is displayed an enemy's orbiting satellite 610 that has been detected to be overhead in the vicinity of an air force base or other strategic location. Moving to FIG. 4B, the laser 200 mounted on a base's airport control tower 300 can aim its laser beam 250 at the satellite and either disable its functionality or destroy it as necessary. FIG. 5A represents a scenario where several ballistic missiles 620 are aimed at the airport and at the aircraft 400 that is on the ground. These missiles 620 can be any type such as intercontinental ballistic missiles (ICBMs) or other ballistic missiles, either hypersonic, supersonic, or subsonic. In drawings FIGS. 5B and 5C are displayed a laser beam 250 targeting each missile 620 in succession. A hypersonic missile is moving extremely fast so this threat must be eliminated in seconds. Also, the laser 200 needs to be able to operate at a high beam intensity in the megawatt range to disable/destroy this threat. In FIG. 6A, a ground-based attack is illustrated. These could be an enemy that is foreign or domestic hostiles armed with rocket-propelled grenades (RPGs) or other ground-based armaments. This figure shows an RPG 630 targeting the above ground turbine building, but the target can obviously be anything at the facility. FIG. 6B illustrates the RPG 630 being destroyed and then in FIG. 6C and FIG. 6D the RPG launcher hostile 640 and another hostile 640 being disabled respectively. The next illustration is in FIG. 7A where an aerial drone 650 is the threat while a base aircraft 400 is on the runway. FIG. 7B shows the aerial drone threat being neutralized while the aircraft 400 remains unharmed. The laser beam 250 could take out a swarm of drones, which is a recent form of aerial drone threats, although only one appears here. Next is a situation where the threat, in FIG. 8A, is several ground-based or wheeled drones 600, where in FIG. 8B all the wheeled drones are being destroyed by several laser beams 250. Note that in all these drawings the in-ground configuration of the turbine 150 (e.g., the GE® LM6000 turbine) was included. These drawings could just as easily use the above ground configuration 100 and be equally effective.

Figure 9A:
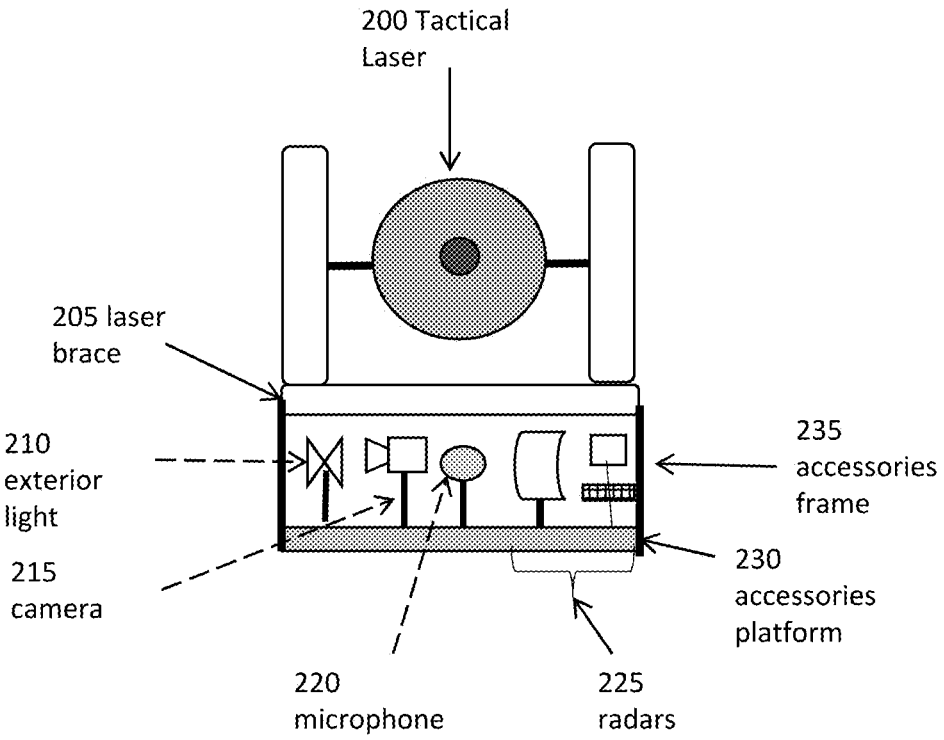
FIG. 9A depicts an enlarged view of the tactical laser and accessory components of the tactical laser defense system of FIG. 2.
Figure 9B:
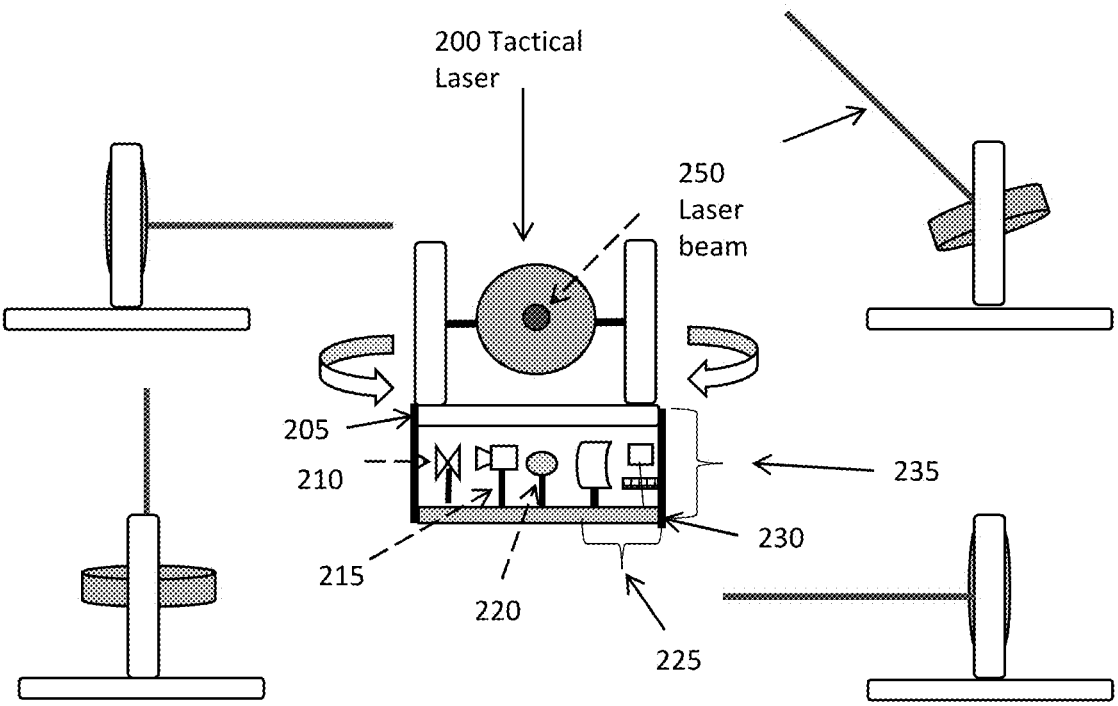
FIG. 9B depicts various positions of the tactical laser of FIG. 9A and the associated laser beam of the laser.

To get a close-up view of the illustrative embodiment of the laser with the accessories pack that has been shown in the prior figures, refer to FIG. 9A for a close-up view of these components. Starting with the tactical laser 200, it is evident that it sits on a laser base 205 and below the base is the accessories pack which consists of a viewing light 210, a microphone 220, and a 360° camera 215. The purpose of these three components is to extend the laser support teams' viewing capabilities. There are also several radar antennas 225 inside the accessories frame 235 which include various radar, Doppler radar, and other methods of detection. These four components rest on an accessory's platform 230 as part of the frame under the laser housing. The camera 215 is equipped with night-vision capabilities. The light is to be used as needed as are the camera and microphone. The intelligence to direct the firing direction and intensity of the laser based on intel (from weapons recognition and other advanced software) for any perceived threat is housed elsewhere and the directions relayed to the laser via the power/communications cable. The laser can be set to automatic or manual firing as desired. To get a better sense of the functionality and flexibility of movement for the laser 200, refer to in FIG. 9B, various views of movement of the tactical megawatt laser 200 and the associated laser beam 250. The center view in this figure shows that the laser 200 is mounted on a brace 205 to which the accessories frame 235 is attached. FIG. 9B also illustrates that the entire laser structure 200 can rotate and tilt so that the beam's direction is more flexible.

Figure 10A:
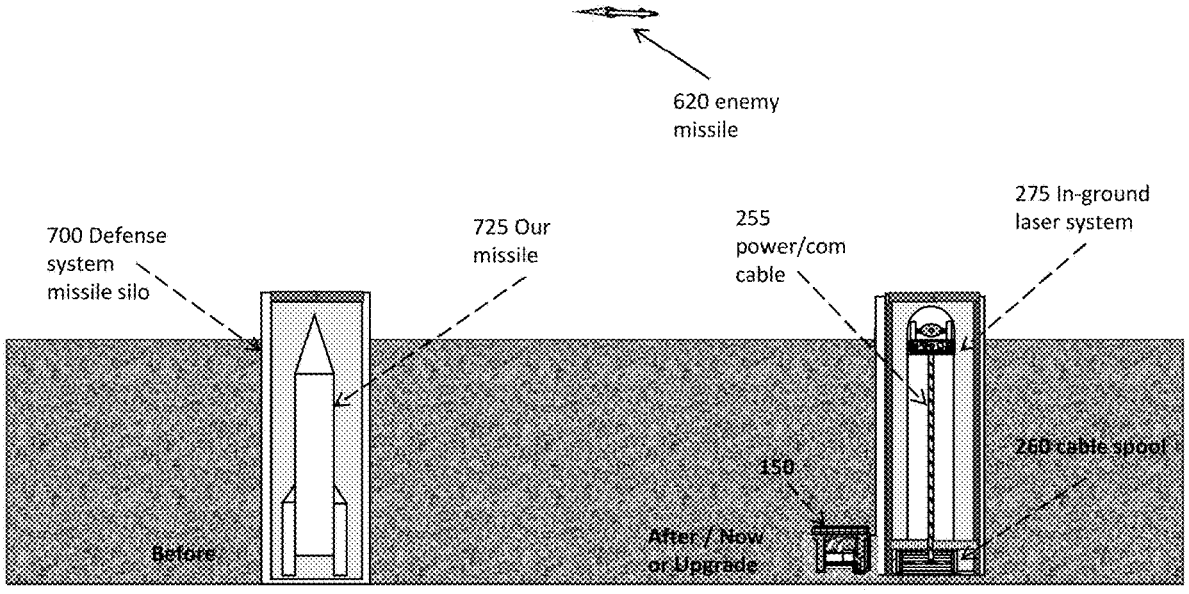
FIG. 10A diagrammatically depicts an in-ground installation of a tactical laser defense system together with an in-ground missile silo, according to another alternative illustrative embodiment of the invention.
Figure 10B:
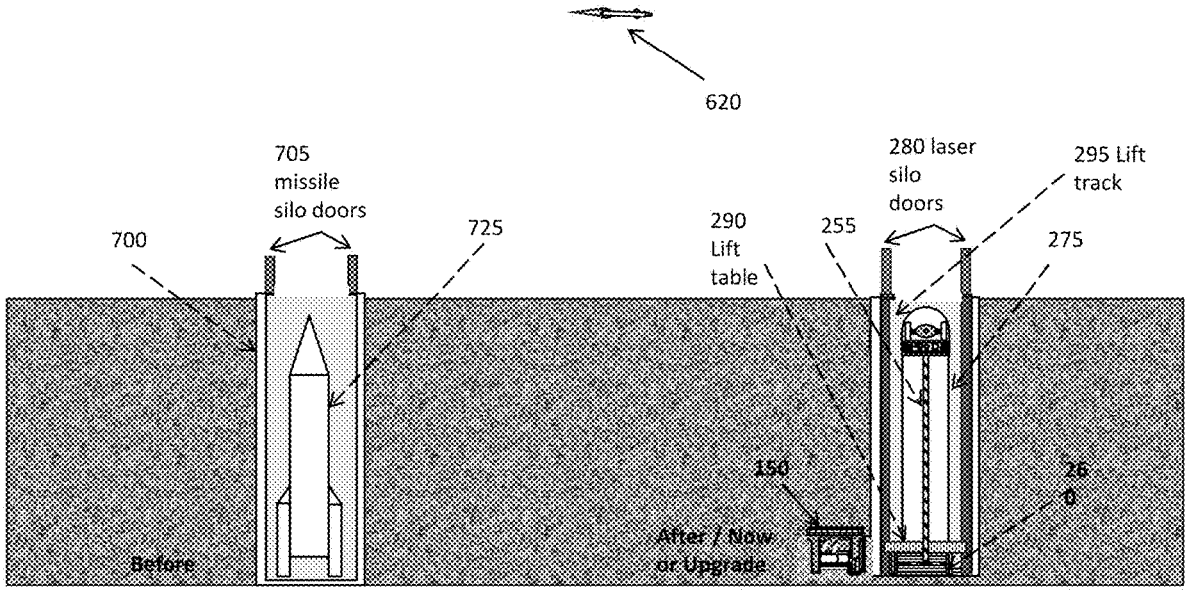
FIG. 10B depicts the missile silo doors and the laser silo doors of the tactical laser defense system of FIG. 10A being opened for combating an enemy missile attack.
Figure 10C:
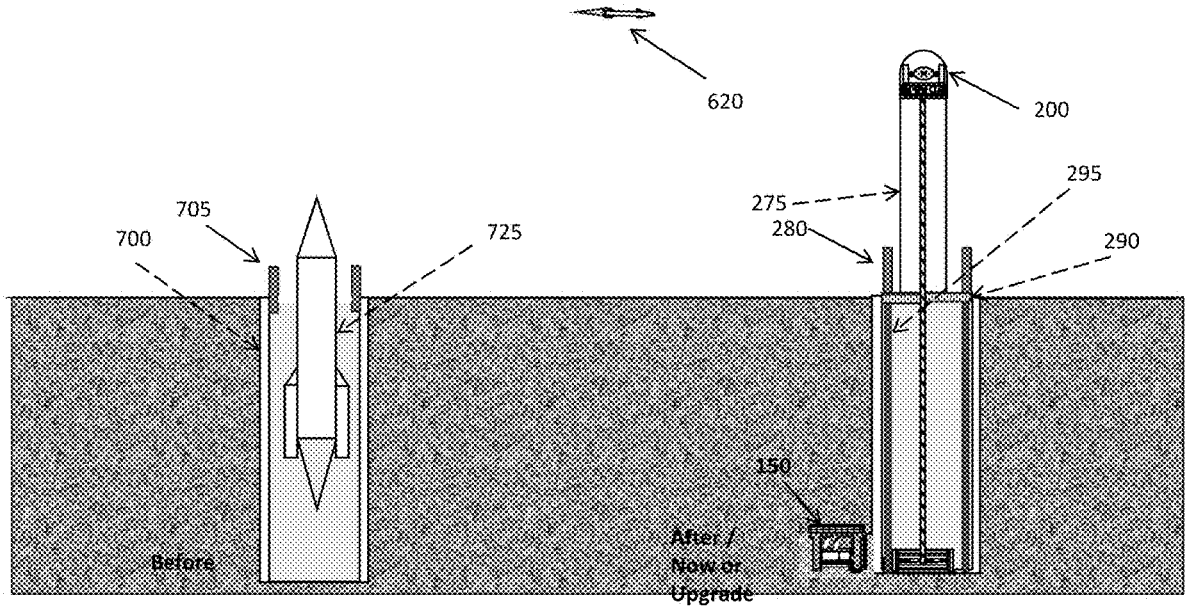
FIG. 10C depicts the exiting of the missile from the in-ground missile silo and the raising of the laser tower from laser silo of the tactical laser defense system of FIG. 10A to combat the enemy missile attack.
Figure 10D:
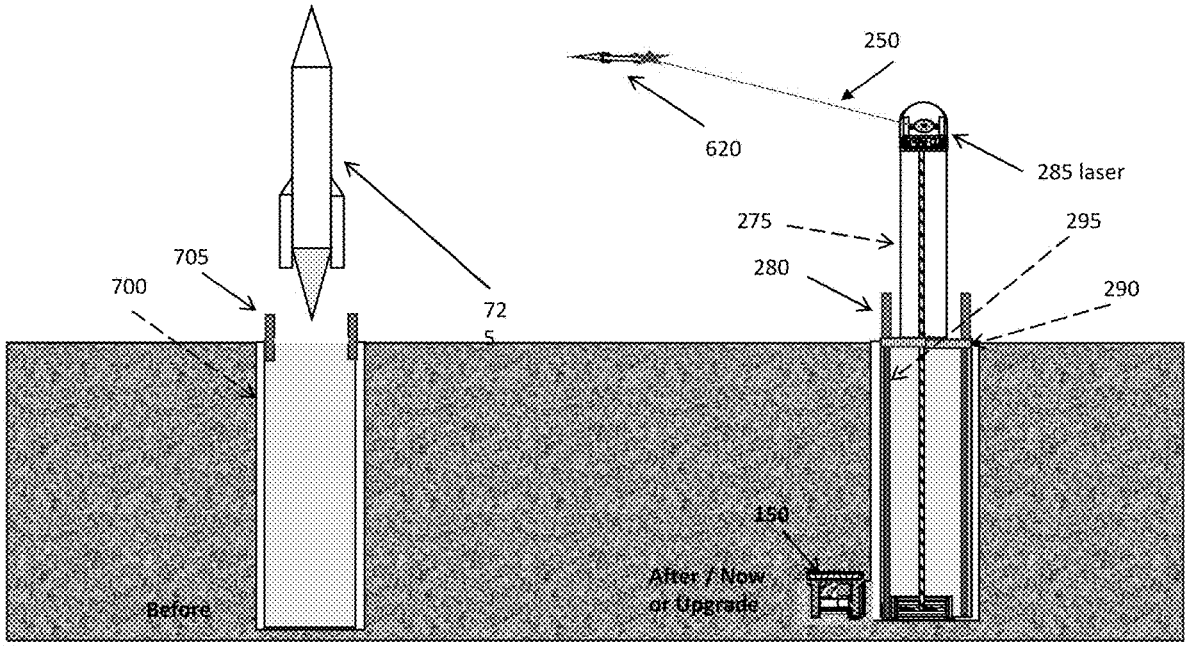
FIG. 10D depicts the enemy missile being hit by a laser beam from the tactical laser on the laser tower of the tactical laser defense system of FIG. 10A.
Figure 11:
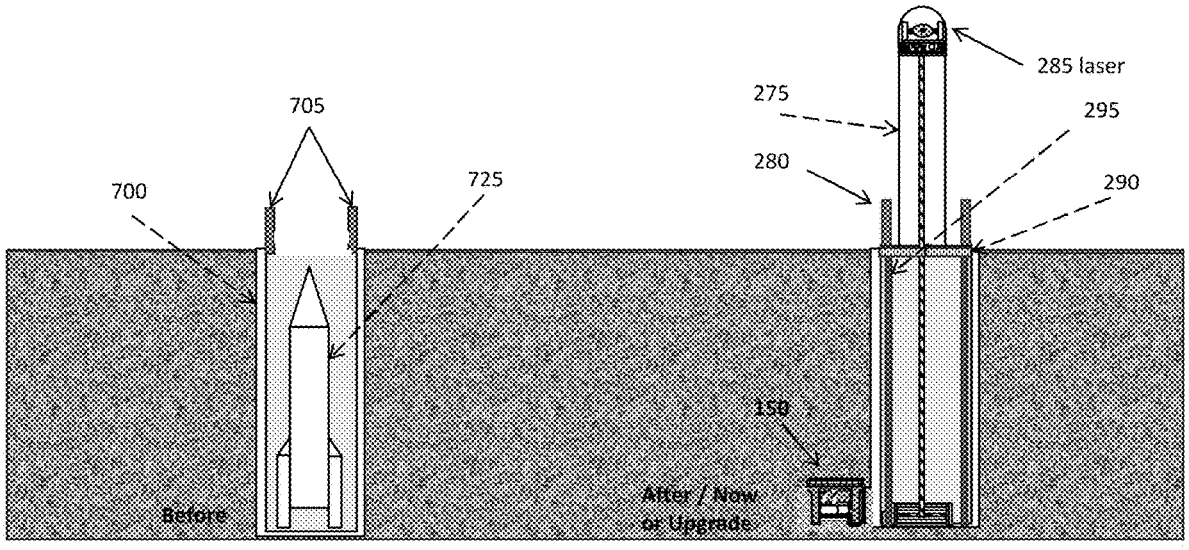
FIG. 11 depicts the missile silo doors being opened, and the laser tower of the tactical laser defense system of FIG. 10A being raised so as to be ready when an enemy threat has been established.
Figure 12:
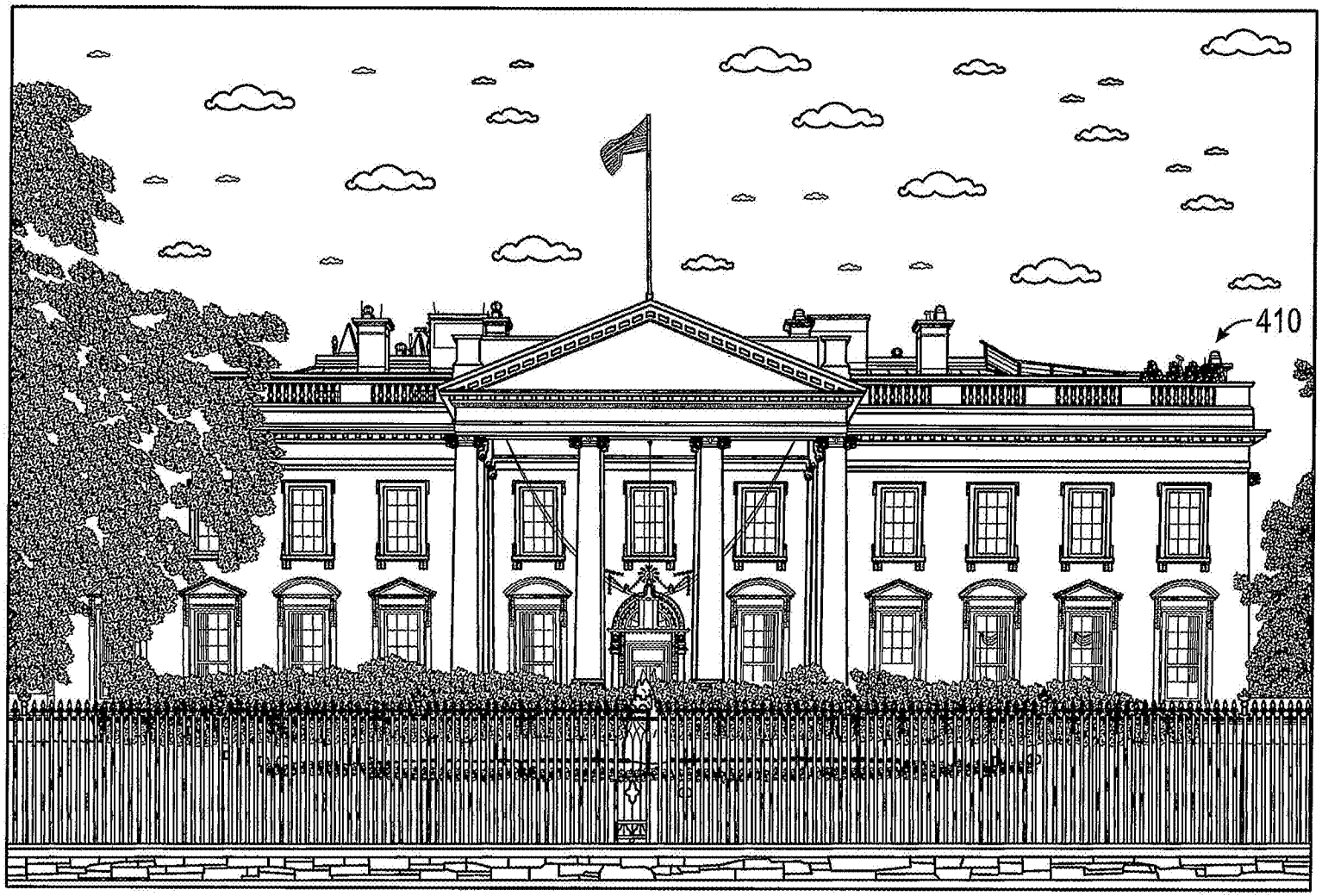
FIG. 12 depicts a first example of another facility that may be protected by the tactical laser defense system described herein.
Figure 13A:
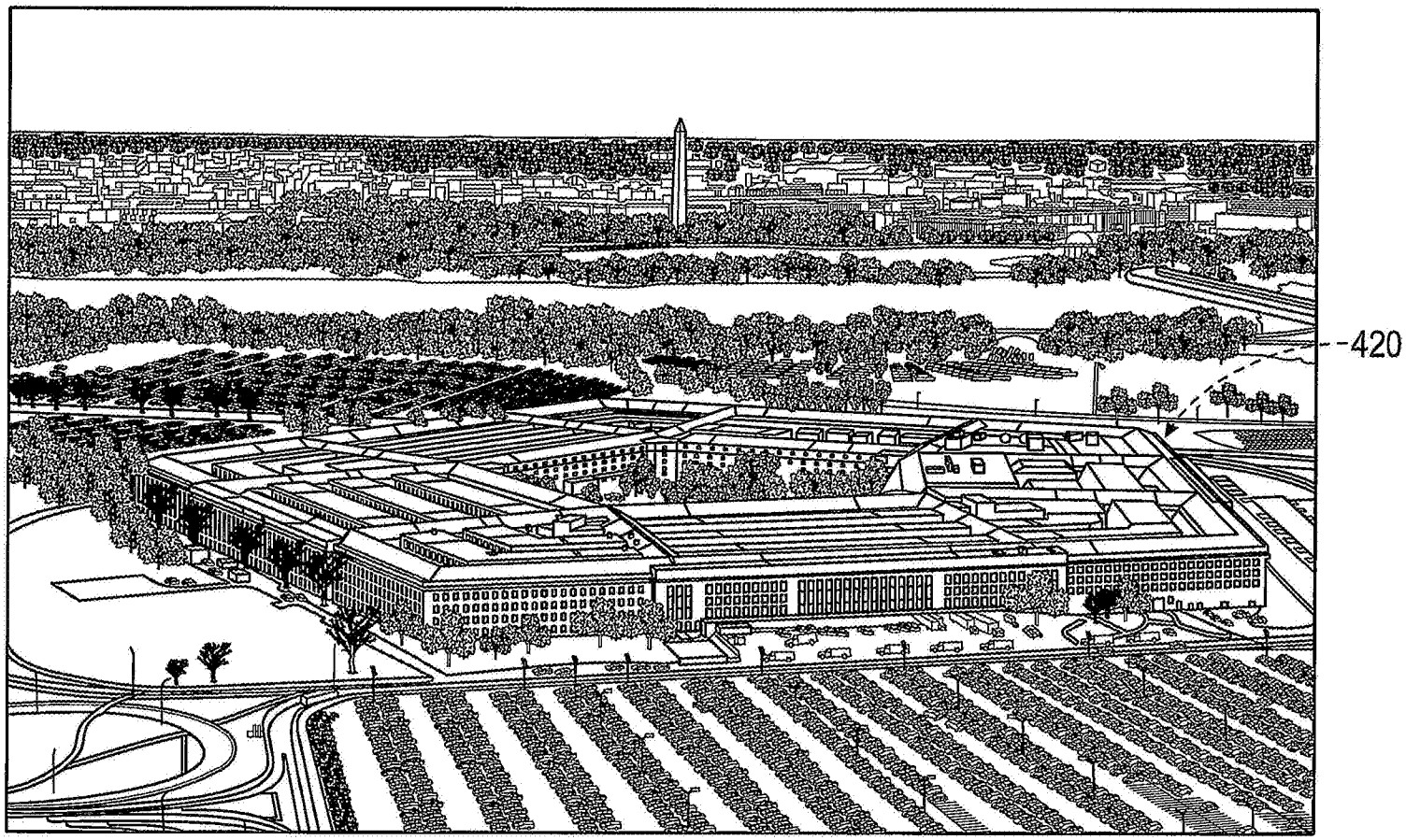
FIG. 13A depicts a second example of yet another facility that may be protected by the tactical laser defense system described herein.
Figure 13B:
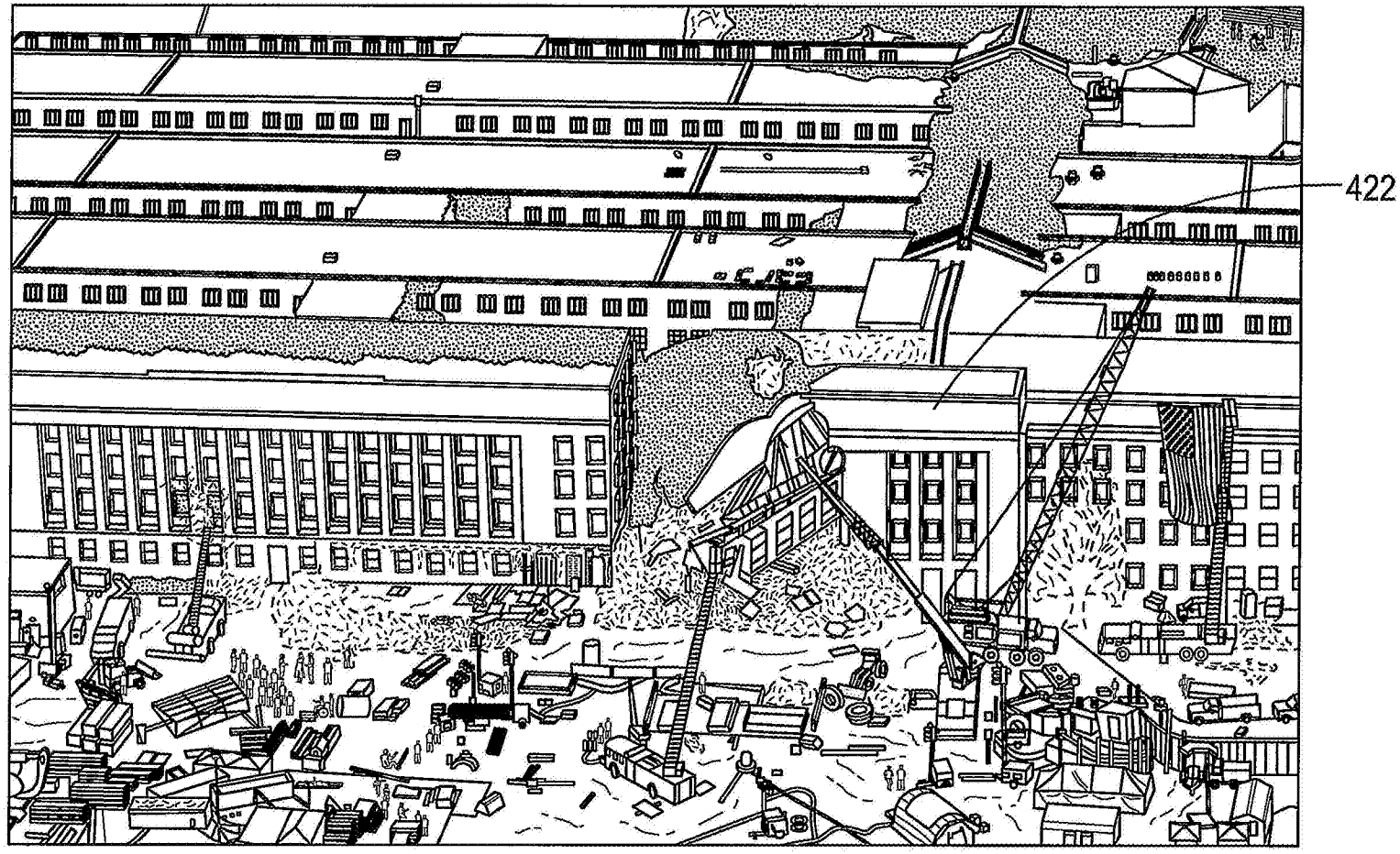
FIG. 13B depicts damage done to the facility depicted in FIG. 13A that could have been prevented by the implementation of the tactical laser defense system described herein.
Figure 13C:
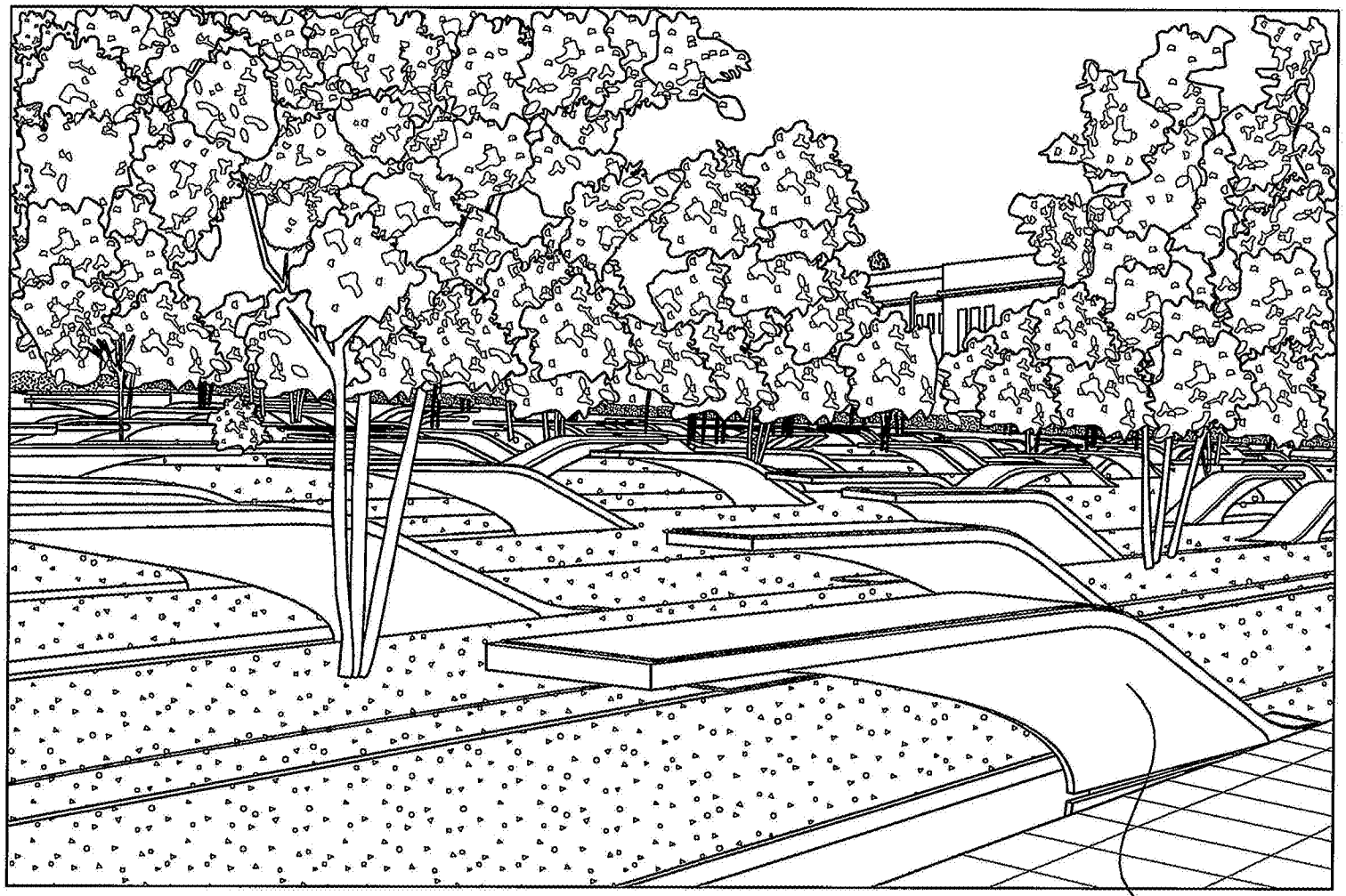
FIG. 13C depicts a memorial near the facility depicted in FIG. 13A.
Figure 14:
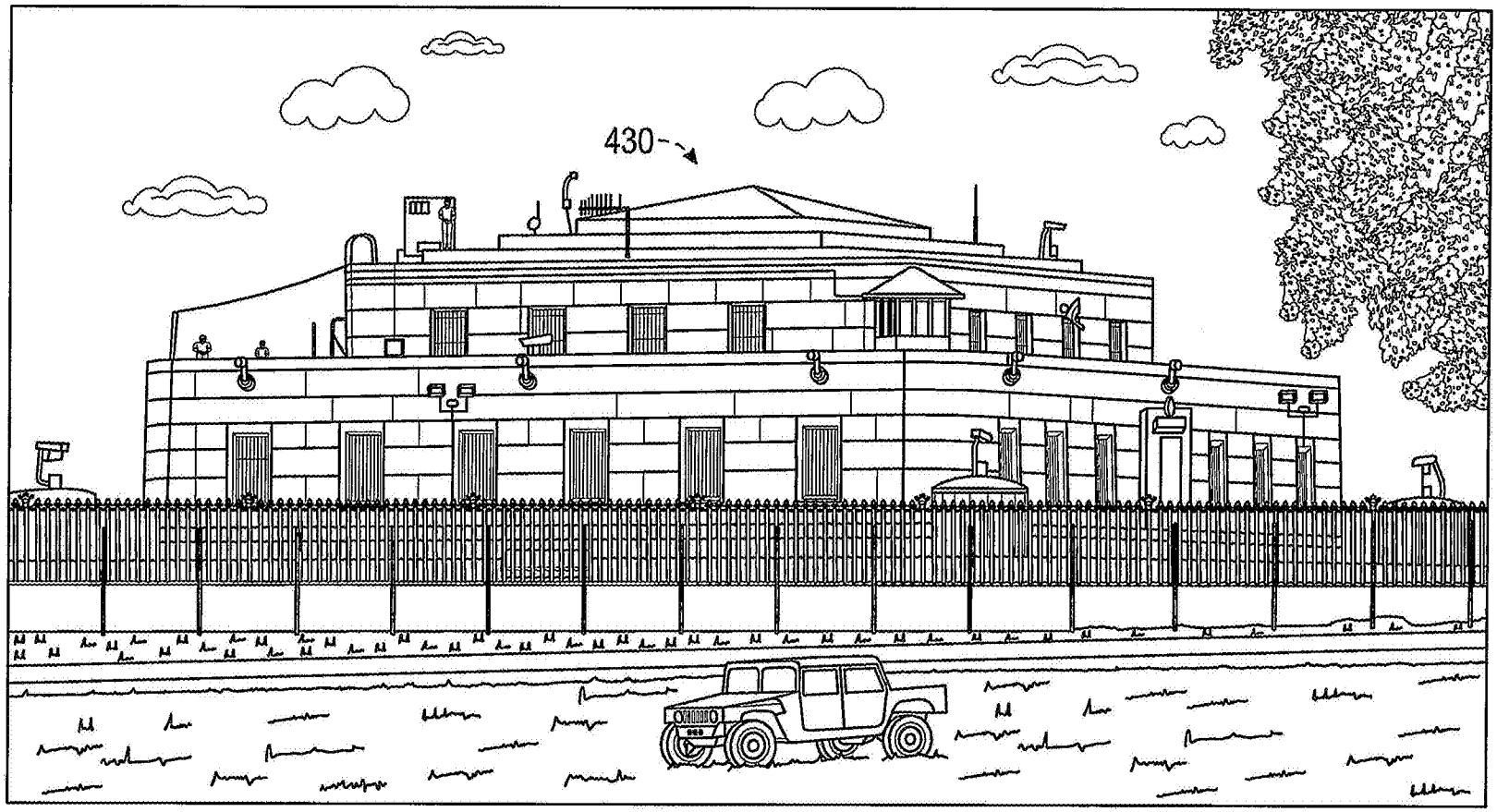
FIG. 14 depicts a third example of still another facility that may be protected by the tactical laser defense system described herein.
Figure 15:
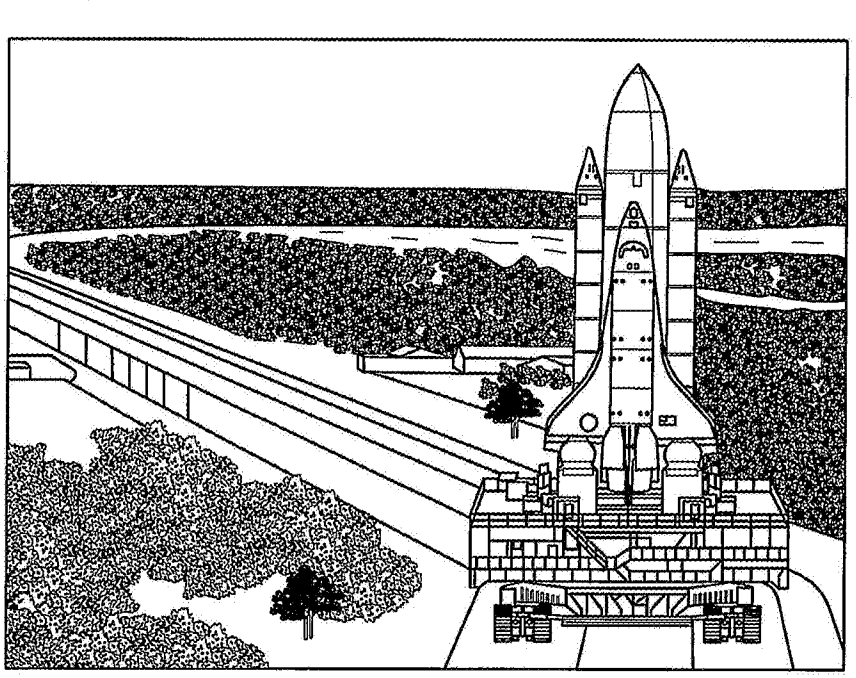
FIG. 15 depicts a fourth example of yet another facility that may be protected by the tactical laser defense system described herein.
Figure 15:
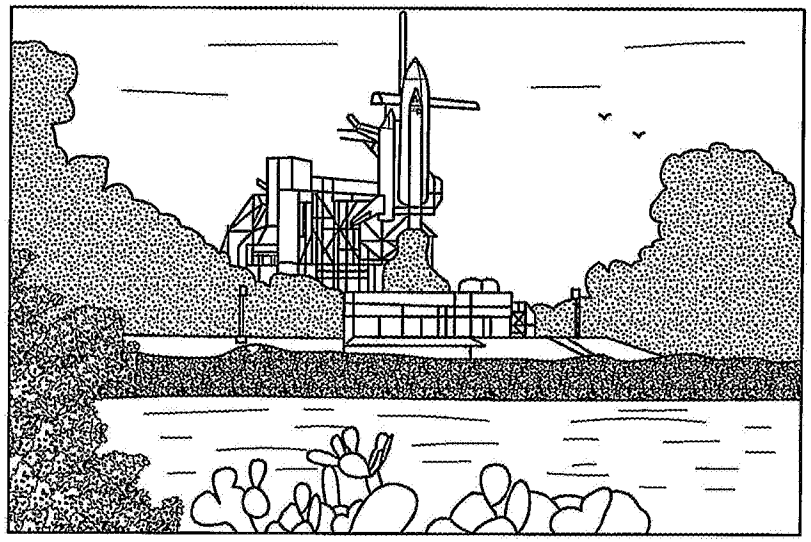

The next group of figures represents the situation where at least one missile in a silo—like those in strategic locations around a country (e.g., around the U.S.)—is illustrated as being replaced by the combination of a turbine (e.g., the GER LM6000 turbine) and a laser of the present illustrative embodiment. In FIG. 10A, the pre-replacement situation (Before) on the left displays a missile silo 700 with a missile 725 inside. The right side of this drawing (After/Now or Upgrade) displays an in-ground turbine 150 (e.g., the GER LM6000 turbine) that powers the laser and all components—the accessories pack—in the in-ground laser system 275. There is a power/communications cable 255 that runs from the turbine to the laser and as that laser system is raised out of its silo the cable unwinds from the cable spool 260 that remains at the bottom of the silo. Also, an enemy missile 620 is shown as having been identified as needing to be destroyed. Moving to FIG. 10B, several additional items are included. First, the missile silo doors 705 are now open—in preparation for a retaliatory missile launch, and for the laser system 275, now identified are the open laser silo doors 280, the lift table 290 that raises the laser tower 275, and the lift tracks 295 on either side of the silo that the lift table uses to raise the laser tower. So, both for the Before and After scenarios, each silo is prepared to handle an enemy threat. In FIG. 10C, the missile 725 has started to exit its silo 700 in the Before scenario. In the After scenario, the high intensity laser 200 in the laser tower 275 has been lifted to its executable or "attack" height via the lift table 290 raising the laser tower on the lift tracks 295. At this point the laser is ready to fire, while the defense missile is still on its way to its overseas target, but not to destroy the incoming threat 620. In FIG. 10D, the laser beam 250 is targeting the threat missile 620 while the "Before" image with the missile, although fired, has not yet reached its target. In FIG. 11 are shown the two systems-Before and After—at rest but in ready-mode when a national threat has been established. One item to note is that the current missiles in silos are available for one-time usage only—in the current configuration if there are multiple missile threats detected, the defense system missiles will have to be launched for several separate silos as a counter-measure—while the lasers can be fired repeatedly thus providing defense to neutralize and/or destroy incoming threats.

The aforedescribed drawings indicate that the facilities being protected by the system described herein are air force bases, but these defense upgrades are appropriate at many facilities starting with the White House 410 (see FIG. 12) and the Pentagon 420 (see figures FIG. 13A, FIG. 13B and FIG. 13C) where for the Pentagon the three images are indicative of the destruction that happened on Sep. 11, 2001 at that location 422 (see FIG. 13B) and the loss of lives (refer to the Pentagon 9/11 Memorial 424 in FIG. 13C) for not having had sufficient defensive measures in place for such an unexpected attack. These two locations are an example of what destruction on Sep. 11, 2001—or intended destruction of the White House—the present invention could prevent. The attacks on Sep. 11, 2001 have proved that these two facilities are terrorist targets. The system described herein is also desirable at all US military bases-especially Fort Knox 430 (see FIG. 14), major defense contractor locations (like GE®) and Pratt & Whitney®), plus Cape Kennedy 440 (see FIG. 15). The base at Fort Knox is mentioned because, along with several other strategic locations like New York, a significant portion of gold is stored there. A threat strike at these locations could have a devastating effect on our economy if the gold at these locations is rendered unusable. The proliferation of drones and hypersonic missiles makes all these targets more vulnerable now.

Figure 16A:
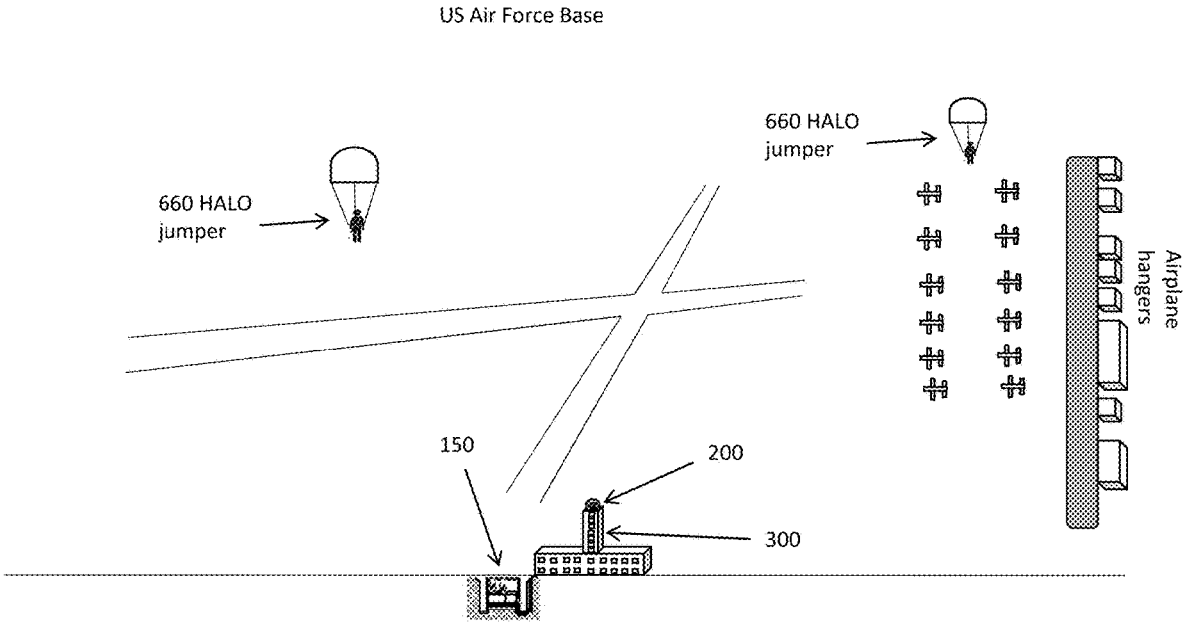
FIG. 16A depicts an aerial threat in a form of halo jumpers that have been identified in the vicinity of the air force base with the tactical laser defense system of FIG. 2.
Figure 16B:
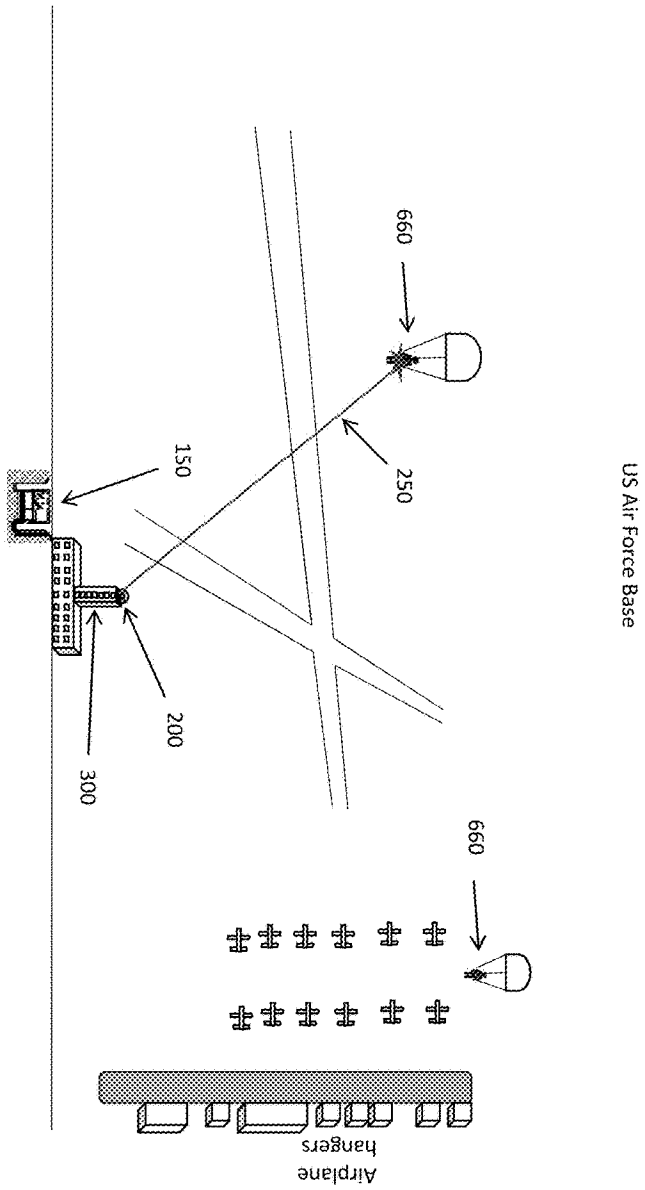
FIG. 16B depicts a first one of the halo jumpers being hit by a laser beam from the tactical laser of the tactical laser defense system of FIG. 2.
Figure 16C:
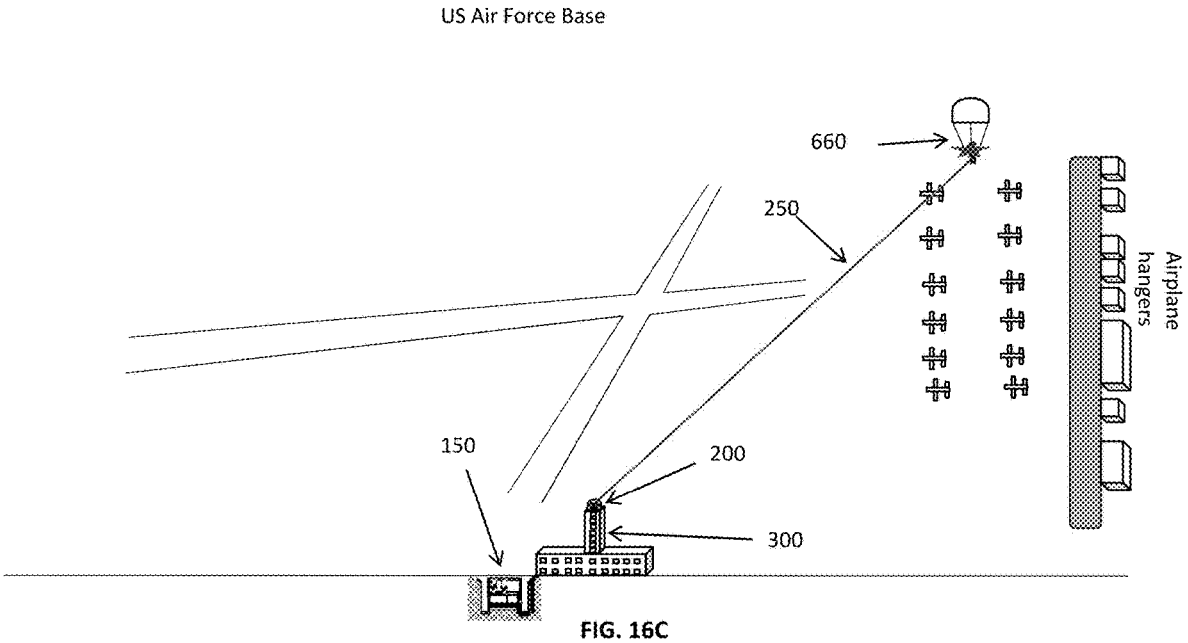
FIG. 16C depicts a second one of the halo jumpers being hit by a laser beam from the tactical laser of the tactical laser defense system of FIG. 2.

Another new threat is displayed in FIG. 16A which is a halo jumper 660 threat attacking in two areas. These halo jumpers are normally not looked for or detected but with the advanced monitoring technology in place, we can now identify this threat. FIG. 16B and FIG. 16C illustrate these threats being eliminated. As in other drawings, note that the laser can be operated repeatedly—in rapid succession—unlike more conventional weapons.

In these one or more embodiments, an offensive and defensive addition to key U.S. facilities, which may be named a "coast-to-coast border-to-border tactical laser defense network" is provided. Each tactical laser defense system in the network may include a GE® LM6000 turbine and a high-intensity tactical megawatt laser tower that includes a camera, a viewing light, a microphone, and various radar equipment. The turbine can be installed in-ground or above ground at these facilities with the ability for the turbine to be an alternate power source for the installation facility as well as supply power to the tactical laser and laser components. The turbine and tactical laser can also replace existing missiles in silos around the country—with some necessary modifications.

In these one or more embodiments, the above ground installation for the LM6000 turbine is protected from unauthorized access by being in a restricted area with limited access from even facility personnel and with the area having its own means of defense against intruders.

In these one or more embodiments, the in-ground installation for the LM6000 turbine includes a pit with concrete lined sloped entry walls, to deter ground assaults, a sump pump, and sump pump drainage line. The depth of the pit, thickness of the concrete liners and other specifics for this in-ground installation may be left to the discretion of the facility planners.

In these one or more embodiments, the high-intensity tactical megawatt laser tactical laser defense system is in a tower that is enclosed in a frame or housing, is mounted on a brace (part of the accessories frame that contains the external light, camera, microphone and radar all placed on an accessories platform in the accessories frame) so the laser can rotate as needed to have the laser beam reach its intended target where the entire laser tower is meant to be placed in a high-point at these facilities such as a control tower at air force base airports or other tall structures.

In these one or more embodiments, the laser brace that the tactical laser is mounted on allows the laser to rotate in any direction.

In these one or more embodiments, the external viewing light, which may include night or infrared vision, is part of the laser accessories housed in a frame below the laser.

In these one or more embodiments, the 360-degree camera is part of the laser accessories housed in a frame below the laser.

In these one or more embodiments, the microphone is part of the laser accessories housed in a frame below the laser.

In these one or more embodiments, the radar devices are part of the laser accessories housed in a frame below the laser.

In these one or more embodiments, the accessories platform to which the external light, the camera, the microphone, and the radar devices are mounted forms a bottom part of the accessories frame.

In these one or more embodiments, the accessories frame encloses the laser accessories, and has the laser brace at its upper edge, and so is mounted below the tactical laser in the laser tower.

In these one or more embodiments, the power/communications cable that relays power and firing directions to the laser can pass information from the laser accessories back to the laser support team as needed.

In these one or more embodiments, there is provided an in-ground laser system where the LM6000 turbine and laser tower are installed below ground in a modified missile silo. Both the turbine and laser tower are below ground in these embodiments, and when needed, the laser silo doors open, and the laser tower is raised to the surface via a lift table that moves on lift tracks with a power/communications cable that unrolls from a cable spool to supply power to the laser tower.

In these one or more embodiments, the cable spool that holds the unused power/communications cable is used in any installations where the laser tower is below ground and raised to the surface via a lift table and lift tracks.

In these one or more embodiments, the lift table, which the laser tower rests on for a below-ground installation, enables the laser tower to be moved to the surface for firing or in preparation for any defense activity.

In these one or more embodiments, the laser tower is further provided with lift tracks and motorized means (e.g., one or more electric motors) to raise the lift table.

In these one or more embodiments, the installation site for the tactical laser defense system is an air force base—where the laser tower can be mounted on the control tower thereof. Other installation sites for the tactical laser defense systems include other military facilities, key defense contractor sites that are manufacturing defense equipment, the White House, the Pentagon, and Fort Knox.

In these one or more embodiments, the turbine (e.g., the GER LM6000 turbine) of the tactical laser defense system may use alternative fuel sources, such as jet fuel or gasoline, in addition to natural gas or propane.

It is readily apparent that the aforedescribed tactical laser defense system offers numerous advantages and benefits. For example, the benefits of the tactical laser defense system of the illustrative embodiment may include:

i. In the illustrative embodiment, the LM6000 turbine was selected because it is made in the U.S., parts are available, and operational support and repair personnel are already trained. The U.S. Navy and other war ships are currently using the LM6000 turbine as their power source.

ii. The ability to provide defense for key locations and facilities is something never before made available.

iii. The U.S. National Defense System has been in place since the 20th century, but the threats available now cannot be defeated by the weapons we currently have in place, but this invention provides a solution that meets current—and future—threats.

iv. Current threats like drones, drone swarms and advanced missiles have come on the scene in recent years and present situations our country has never had to face before. It is now possible to reach the interior territory of the U.S. without our existing defense capabilities being able to provide adequate support. This tactical laser defense system described herein provides a means to counter and defeat these threats.

v. This tactical laser defense system described herein provides defense against foreign and domestic threats that could attempt to disable or destroy existing power grids—and that has already happened several times.

vi. In the not too distant future, with the development of a gigawatt tactical laser, the LM6000 turbine will be able to handle the upgrade and beyond.

vii. In the illustrative embodiment, the LM6000 turbine allows facilities to continue to operate during power outages and with alternative fuel sources, the turbines can operate for long periods of time independently, i.e., off the grid.

viii. The tactical lasers of the illustrative embodiment have the following benefits:

a. Lasers travel at the speed of light so they can reach any target threat instantly.

b. Most other ammunition has a limited number of rounds so that weapon's usage will terminate once all its ammunition is gone whereas a laser can be reused immediately and repeatedly.

c. The intensity of a laser beam is adjustable thus making one laser more flexible in how it is used as a weapon.

d. Cost—shooting a laser costs pennies whereas firing most other weapons cost thousands or hundreds of thousands of dollars to use.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A tactical laser defense system, comprising:

one or more tactical lasers, the one or more tactical lasers configured to emit one or more respective laser beams at a particular target;

one or more other tactical devices, the one or more other tactical devices comprising at least one of: (i) a camera to capture images and/or video of an area surrounding the tactical laser defense system, (ii) a light source for illuminating the area surrounding the tactical laser defense system, (iii) a microphone for capturing audio information from the area surrounding the tactical laser defense system, and (iv) radar equipment for detecting enemy threats; and a power source operatively coupled to the one or more tactical lasers and the one or more other tactical devices, the power source configured to provide electrical power to the one or more tactical lasers and the one or more other tactical devices;

wherein the one or more tactical lasers and the one or more other tactical devices are configured to be installed underground, in-ground, or above ground for protecting a particular facility; and wherein the power source for the one or more tactical lasers and the one or more other tactical devices comprises a turbine, the turbine configured to be installed underground, in-ground, or above ground, and the turbine configured to operate as an alternate power source for the particular facility.

2. The tactical laser defense system according to claim 1, wherein the turbine is installed in-ground or underground in a pit, the pit being surrounded by barrier walls, at least one of the barrier walls being sloped to so as to deter ground assaults on the pit, and the pit further comprising a sump pump and sump pump drainage line for removing any accumulated water from the pit.

3. The tactical laser defense system according to claim 2, wherein the one or more tactical lasers and the one or more other tactical devices are mounted on a tower structure, and the tower structure is installed in-ground or underground in a subterranean silo adjacent to the pit with the turbine, the subterranean silo including one or more operable doors at an upper end of the subterranean silo;

wherein, when the one or more operable doors at the upper end of the subterranean silo are opened, the tower structure is raised to above a surface of the ground so that the one or more tactical lasers are in an operative position for emitting the one or more respective laser beams at the particular target.

4. The tactical laser defense system according to claim 3, wherein the tower structure is disposed on a lift table that is configured to be displaced along one or more lift tracks as the tower structure is raised to above the surface of the ground.

5. The tactical laser defense system according to claim 4, further comprising an electrical power cable and/or an electrical communications cable, the electrical power cable configured to provide power to at least the one or more tactical lasers and one or more other tactical devices of the tactical laser defense system, and the electrical communications cable configured to provide communication signals to at least the one or more tactical lasers so that aiming and firing of the one or more tactical lasers are able to be controlled by operators at the particular facility.

6. The tactical laser defense system according to claim 5, further comprising a spooling winch assembly that includes a cable spool to hold an unextended portion of the electrical power cable and/or the electrical communications cable;

wherein, as the tower structure is raised to the surface of the ground with the lift table displaced along the one or more lift tracks, the electrical power cable and/or the electrical communications cable unrolls from the cable spool of the spooling winch assembly.

7. The tactical laser defense system according to claim 1, wherein the turbine is configured for one or more of the following fuel sources: (i) jet fuel, (ii) gasoline, (iii) natural gas, (iv) propane, and (v) combinations thereof.

8. The tactical laser defense system according to claim 1, wherein at least one of the one or more tactical lasers of the tactical laser defense system comprises a high-intensity tactical megawatt laser.

9. The tactical laser defense system according to claim 1, wherein the one or more tactical lasers are disposed in an elevated position on a tower structure, and at least one of the one or more tactical lasers of the tactical laser defense system is mounted on a brace structure, the brace structure allowing the at least one of the one or more tactical lasers to be rotated and/or tilted as needed to aim the at least one of the one or more tactical lasers at the particular target.

10. The tactical laser defense system according to claim 9, further comprising an accessory frame and an accessory platform, the accessory frame being attached between the brace structure of the tactical laser defense system and the accessory platform, the one or more other tactical devices being mounted on the accessory platform, and the accessory platform being mounted on the tower structure in the elevated position.

11. The tactical laser defense system according to claim 10, wherein the one or more other tactical devices of the tactical laser defense system include the camera to capture images and/or video of the area surrounding the tactical laser defense system, the camera being mounted on the accessory platform and being disposed within the accessory frame beneath the one or more tactical lasers.

12. The tactical laser defense system according to claim 10, wherein the one or more other tactical devices of the tactical laser defense system include the light source for illuminating the area surrounding the tactical laser defense system, the light source emitting visible light and/or infrared light, and the light source being mounted on the accessory platform and being disposed within the accessory frame beneath the one or more tactical lasers.

13. The tactical laser defense system according to claim 10, wherein the one or more other tactical devices of the tactical laser defense system include the microphone for capturing audio information from the area surrounding the tactical laser defense system, and the microphone being mounted on the accessory platform and being disposed within the accessory frame beneath the one or more tactical lasers.

14. The tactical laser defense system according to claim 10, wherein the one or more other tactical devices of the tactical laser defense system include the radar equipment for detecting enemy threats, and the radar equipment being mounted on the accessory platform and being disposed within the accessory frame beneath the one or more tactical lasers.

15. The tactical laser defense system according to claim 9, wherein the tower structure is mounted on a top of a control tower or other building structure at the particular facility.

16. A tactical laser defense system, comprising:

one or more tactical lasers, the one or more tactical lasers configured to emit one or more respective laser beams at a particular target, and at least one of the one or more tactical lasers of the tactical laser defense system comprises a high-intensity tactical megawatt laser;

one or more other tactical devices, the one or more other tactical devices comprising at least one of: (i) a camera to capture images and/or video of an area surrounding the tactical laser defense system, (ii) a light source for illuminating the area surrounding the tactical laser defense system, (iii) a microphone for capturing audio information from the area surrounding the tactical laser defense system, and (iv) radar equipment for detecting enemy threats; and a power source operatively coupled to the one or more tactical lasers and the one or more other tactical devices, the power source configured to provide electrical power to the one or more tactical lasers and the one or more other tactical devices;

wherein the one or more tactical lasers and the one or more other tactical devices are configured to be installed underground, in-ground, or above ground for protecting a particular facility; and wherein the power source for the one or more tactical lasers and the one or more other tactical devices comprises a turbine, the turbine configured to be installed underground, in-ground, or above ground.

17. The tactical laser defense system according to claim 16, wherein the turbine is installed in-ground or underground in a pit, the pit being surrounded by barrier walls, at least one of the barrier walls being sloped to so as to deter ground assaults on the pit, and the pit further comprising a sump pump and sump pump drainage line for removing any accumulated water from the pit.

18. The tactical laser defense system according to claim 16, wherein the turbine is configured for one or more of the following fuel sources: (i) jet fuel, (ii) gasoline, (iii) natural gas, (iv) propane, and (v) combinations thereof.

19. The tactical laser defense system according to claim 16, wherein the turbine is configured to operate as an alternate power source for the particular facility.

20. A tactical laser defense system, comprising:

one or more tactical lasers, the one or more tactical lasers configured to emit one or more respective laser beams at a particular target;

one or more other tactical devices, the one or more other tactical devices comprising at least one of: (i) a camera to capture images and/or video of an area surrounding the tactical laser defense system, (ii) a light source for illuminating the area surrounding the tactical laser defense system, (iii) a microphone for capturing audio information from the area surrounding the tactical laser defense system, and (iv) radar equipment for detecting enemy threats; and a power source operatively coupled to the one or more tactical lasers and the one or more other tactical devices, the power source configured to provide electrical power to the one or more tactical lasers and the one or more other tactical devices;

wherein the one or more tactical lasers and the one or more other tactical devices are configured to be installed underground, in-ground, or above ground for protecting a particular facility; and wherein the one or more tactical lasers are disposed in an elevated position on a tower structure, and at least one of the one or more tactical lasers of the tactical laser defense system is mounted on a brace structure, the brace structure allowing the at least one of the one or more tactical lasers to be rotated and/or tilted as needed to aim the at least one of the one or more tactical lasers at the particular target.

* * * * *